US006142855A

United States Patent [19]

Nyui et al.

[11] Patent Number: 6,142,855

[45] Date of Patent: Nov. 7, 2000

[54] POLISHING APPARATUS AND POLISHING METHOD

[75] Inventors: Masaru Nyui, Utsunomiya; Mikichi Ban, Haga-machi; Takehiko Suzuki, Satte; Yasushi Sugiyama, Minami Kawachi-machi, all of Japan

[73] Assignee: Canon Kabushiki Kaisha, Tokyo, Japan

[21] Appl. No.: 09/182,457

[22] Filed: Oct. 30, 1998

[30] Foreign Application Priority Data

Oct. 31, 1997 [JP] Japan ..... 9-300331

[51] Int. Cl.[7] ..... B24B 7/00

[52] U.S. Cl. ..... 451/67; 356/381

[58] Field of Search ..... 451/5, 6, 8, 41, 451/67; 356/381, 382; 250/559.27, 559.28

[56] References Cited

U.S. PATENT DOCUMENTS

| | | | |
|---|---|---|---|
| 5,081,796 | 1/1992 | Schultz . | |
| 5,120,966 | 6/1992 | Kondo | 250/372 |
| 5,191,393 | 3/1993 | Hignette et al. | 356/384 |
| 5,337,150 | 8/1994 | Mumola | 356/382 |
| 5,365,340 | 11/1994 | Ledger | 356/357 |
| 5,543,919 | 8/1996 | Mumola | 356/382 |
| 5,555,474 | 9/1996 | Ledger | 356/381 |
| 5,747,201 | 5/1998 | Nakayama et al. | 430/30 |
| 5,747,813 | 5/1998 | Norton et al. | 250/372 |
| 5,872,633 | 2/1999 | Holzapfel et al. | 356/381 |
| 5,899,792 | 5/1999 | Yagi | 451/6 |
| 6,004,187 | 12/1999 | Nyui et al. | 451/5 |

FOREIGN PATENT DOCUMENTS 2574807 3/1989 Japan .

*Primary Examiner*—Timothy V. Eley
*Assistant Examiner*—Dung Van Nguyen
*Attorney, Agent, or Firm*—Fitzpatrick, Cella, Harper & Scinto

[57] ABSTRACT

In order to measure a thickness of a surface to be polished of a material to be polished for a short time, two-dimensional images are obtained from a light reflected from the surface to be polished of the material to be polished, a location at which a thickness is to be observed is specified by the obtained two-dimensional images, and thickness measurement is carried out.

6 Claims, 19 Drawing Sheets

X
Y
C
g
1
2
4
5
6
7
8
9
10
11
12
16
18
20
21
22
23
24
25
26
W1
W2
W3

PRIOR ART

POLISHING APPARATUS AND POLISHING METHOD

BACKGROUND OF THE INVENTION

1. Field of the Invention

The present invention relates to a polishing apparatus which has observing means for observing a surface of a material to be polished and a polishing method of polishing a material to be polished using the polishing apparatus.

2. Related Background Art

In the recent years where progresses have been made in configuration of ultra fine semiconductor devices and sophisticatedly stepped semiconductor devices, chemical-mechanical polishing (CMP) apparatuses are known as a working means for polishing with high precision, SOI substrates, semiconductor wafers made of Si, GeAs, InP and the like, wafers having insulating films or metal films formed on surfaces thereof in processes of manufacturing integrated semiconductor circuits, and substrates for displays.

A CMP apparatus which was used by the inventors before achieving the present invention will be described with reference to FIG. 23. FIG. 23 schematically shows the polishing apparatus which was used by the inventors. before achieving the present invention, wherein a material to be polished (wafer) 100 is held by a holding means 200 for holding a material to be polished in a condition where its surface to be polished faces downward and the material to be polished 100 is polished with a polishing pad 400 which has a diameter larger than that of the material to be polished 100 and is made, for example, of polyurethane. This polishing pad 400 mostly has irregularities on a surface thereof or is porous. In FIG. 23, the material to be polished 100 is turned in a direction indicated by an arrow S by driving means which is not shown in the drawings. Further, the polishing pad 400 is turned in a direction indicated by an arrow T by driving means which is not shown in the drawings. The surface of the material to be polished 100 is kept in contact with the polishing pad 400 and polished by turning both the material to be polished 100 and the polishing pad 400 relatively to each other or either one of these members. At this time, an abrasive material (slurry) is supplied from slurry supply means 600 to a gap between the material to be polished 100 and the polishing pad 400 which are in contact with each other. The slurry is, for example, an alkaline aqueous solution in which fine particles of $SiO_2$ on the order of microns to submicrons are stably dispersed. In FIG. 23, the slurry is supplied from outside between the material to be polished 100 and the polishing pad 400.

A thickness measuring means 700 aligns (specifies) a location to be measured of the surface of the material to be polished 100, irradiates it with a monochromatic laser and measures the thickness of the material to be polished from a phase deviation of reflected light from the surface to be polished. On the basis of data of a measured thickness value, the CMP apparatus modifies polishing conditions required for obtaining a flat surface which is polished with high precision, for example, a polishing time, and a pressure between the material to be polished 100 and the polishing pad 400 which are in contact with each other, and then polishes once again the surface to be polished.

However, the CMP apparatus described above is incapable of measuring a thickness of a material to be polished, modifying polishing conditions on the basis of a measured results and polishing the material with high precision in a short time since the conventional thickness measuring means requires a long time to align the location at which a thickness is to be measured of the surface of the material to be polished. Further, the CMP apparatus has a low alignment accuracy, thereby being hardly capable of accurately measuring a location at which a thickness is to be measured. Accordingly, obtained thickness values have low reliabilities and are hardly usable as data for modifying polishing conditions.

SUMMARY OF THE INVENTION

A primary object of the present invention is to provide a polishing apparatus comprising a measuring means which captures a location for measurement within a surface of a material to be polished in a short time with high precision and measures the thickness of the material to be polished at the location with high precision, and is to provide a polishing method using the polishing apparatus.

The present invention therefore provides a polishing apparatus comprising: a polishing head having a polishing surface which is opposed to a surface of a material to be polished and polishes the material to be polished, a holding means which holds the surface of the material to be polished, a thickness measuring means which measures a thickness of the material to be polished, and an image pickup means which picks up images of a predetermined region of the surface to be polished at different focal points at a time, wherein one two-dimensional image information is selected from a plurality of two dimensional image informations picked up by the pickup means and a location to be used for measuring a thickness of the surface to be polished is determined from the one two-dimensional image information, and the thickness measuring means measures the thickness of the surface to be polished at the location.

Further, the present invention provides a polishing method of polishing a surface of a material to be polished which comprises: an image pickup step of picking up images of a surface of a material to be polished, a location determination step of determining a location which is to be used for measuring a thickness of the surface to be polished from two-dimensional image informations of the surface to be polished, a thickness measurement step of measuring a thickness of the surface of the material to be polished at the location, wherein the images of the surface to be polished are picked up at different focal points at a time, one two-dimensional image information from the obtained plurality of two-dimensional image informations of the surface to be polished, and the location is determined from the one two-dimensional image information, and the thickness of the surface to be polished is measured at the location by a thickness measuring means.

Furthermore, the present invention provides a polishing method comprising: a step of polishing a surface of a material to be polished with a polishing head and a step of irradiating a predetermined region of the surface to be polished with a light bundle emitted from a light source, receiving an interference light bundle from the surface to be polished at a plurality of separate wavelengths, and measuring the thickness of the surface to be polished from spectral reflection intensities of optical signals received separately at the plurality of wavelengths, wherein the step of measuring the thickness consists of: a first step of using a plurality of solutions of thickness values calculated separately from at least three of optical signals received separately at the plurality of wavelengths, selecting a combination of solutions of thickness values which are closest to each other from the plurality of solutions, and determining an approximate thickness value on the surface to be polished from the selected combination of solutions of thickness value; and a second step of using a plurality of solutions of the thickness value calculated separately at each wavelength from all the optical signals received separately at the wavelengths, determining a detail thickness value by restricting a selection range by taking the approximate thickness value obtained in the first step as standard, in selecting the combination of solutions of thickness values which are closest to each other from the plurality of solutions.

Moreover, the present invention provides a polishing method comprising: a step of polishing a surface of a material to be polished with a polishing head, and a step of irradiating a predetermined region of the surface of the material to be polished with a light bundle emitted from a light source, receiving an interference light bundle from the predetermined region of the surface to be polished separately at a plurality of wavelengths, and measuring a thickness of the surface to be polished from a ratio in reflection amplitude and a phase difference between P polarized light and S polarized light calculated from the optical signals received at the plurality of wavelengths, wherein the step of measuring the thickness consists of: a first step of determining an approximate thickness value of the surface to be polished from the selected combination of solutions of thickness values which is closest to each other by using a plurality of solutions of thickness values obtained by comparing a first correlation table, which represents theoretical relationship between a thickness value and a ratio in reflection amplitude and a phase difference between the P polarized light and the S polarized light at each wavelength, with a ratio in reflection amplitude and a phase difference between the P polarized light and the S polarized light which are calculated from optical signals received separately at each of a plurality of measured wavelengths; and a second step of determining a detail thickness by restricting a comparison range by taking the approximate thickness value obtained in the first step as standard, in obtaining a thickness value by comparing a second correlation table, which represents theoretical relationship between a thickness value and a ratio in reflection amplitude and a phase difference between the P polarized light and the S polarized light separately at each of wavelengths selected at an interval narrower in thickness values than that in the first correlation table, with a ratio in reflection amplitude and a phase difference between the P polarized light and the S polarized light which are calculated from optical signals received separately at each of the plurality of measured wavelengths.

Furthermore, the present invention provides a polishing apparatus comprising a polishing head which polishes a surface of a material to be polished, a holding means for holding the material to be polished which holds the material to be polished, a driving means which rotates the holding means for the material to be polished, and a thickness measuring means which specifies a location for measuring a thickness of the material to be polished by irradiating the rotating material to be polished with white light and measuring the thickness at the location.

Moreover, the present invention provides a polishing method of polishing a surface of a material to be polished with a polishing head, which comprises a thickness measurement step of specifying a location for measuring a thickness of the material to be polished by irradiating the rotating material to be polished with white light and measuring the thickness at the location.

The polishing apparatus according to the present invention is capable of picking up images of a surface of a material to be polished by the thickness measuring means, determining a location suited for measurement of a thickness in a short time with high precision on the basis of two-dimensional image informations, accurately measuring a thickness and polishing the material to be polished with high precision on the basis of an obtained result of the thickness measurement.

DETAILED DESCRIPTION OF THE PREFERRED EMBODIMENTS

Prior to description of the polishing apparatus according to the present invention, explanation will be made of a configuration of a thickness measuring means which is to be used in the polishing apparatus according to the present invention and a thickness measuring method which uses the thickness measuring means. Then, description will be made of a first, second, third and fourth embodiments of the polishing apparatus which has the thickness measuring means, and the polishing method which uses the polishing apparatus.

(Thickness Measuring Means according to the Present invention)

The thickness measuring means according to the present invention will be described in details with reference to FIGS. 1 to 16.

Figure 1:
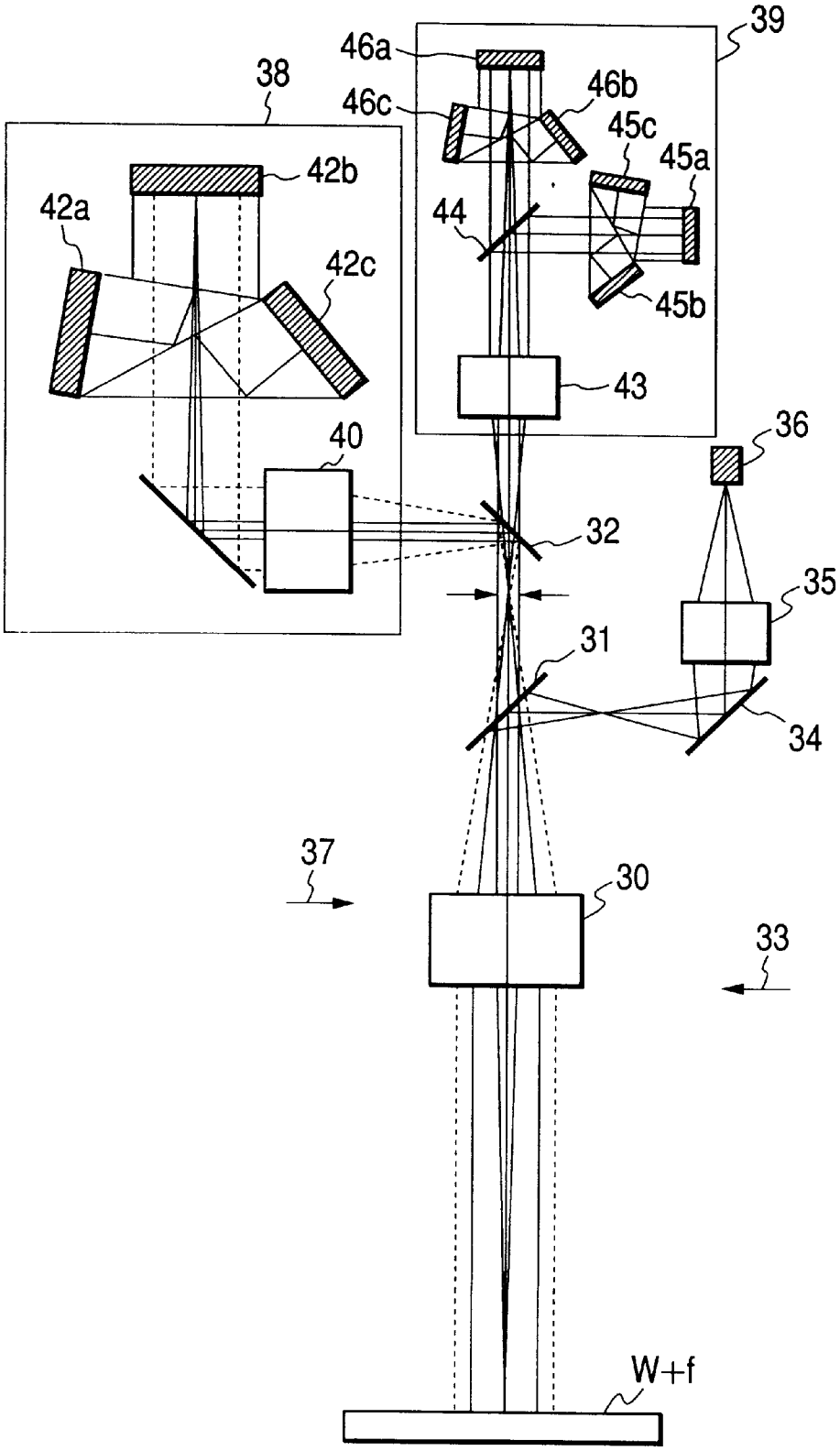
FIG. 1 is a schematic diagram illustrating a configuration of a thickness measuring means according to the present invention by using the spectral reflectance method.

FIG. 1 shows a configuration of a thickness measuring means according to the present invention for measuring a thickness by the interference spectral reflectance method, wherein an objective lens 30 is disposed over a substrate W which has a film layer f formed on a surface thereof, and a first half mirror 31 and a second half mirror 32 are arranged in an optical path over the objective lens 30. Formed in an incident direction of the first half mirror 31 is an illumination optical system 33, wherein a mirror 34, a condenser lens 35 and an optical fiber 36 which is connected to a momentary white light source (not shown in the drawings) are sequentially arranged, an end surface of emergence of the optical fiber 36 is disposed at a location conjugate with an exit pupil of the objective lens 30. The white light used in the present invention is light which is composed of at least three wavelength spectra, or multi-band light, in other word, multi-spectral light.

Further, in the present invention, momentary emission of white light is the same in meaning as emission of multi-spectral light for a short time. The momentary white light can be called flashing multi-spectral light.

Disposed in a transmitting direction of the first half mirror 31 is an image-forming optical system 37 which is branched by the second half mirror 32 into a location detecting-focusing system 38 which is disposed in a reflecting direction thereof to detects a predetermined region on a surface of the substrate W and a thickness measuring system 39 which is disposed in a transmitting direction thereof to measure a film thickness.

An image-forming lens 40, a mirror and CCD light receiving elements 42*a* to 42*c* having a two-dimension arrangement are disposed in the location detecting-focusing system 38. In order to select an image which is formed in an optimum condition in the location detecting-focusing system 38 and determine a location of the image which is suited for measuring a thickness, these CCD light receiving elements are fixed at a plurality of different locations so as to provide image-formed conditions which are different from one another.

Figure 2:
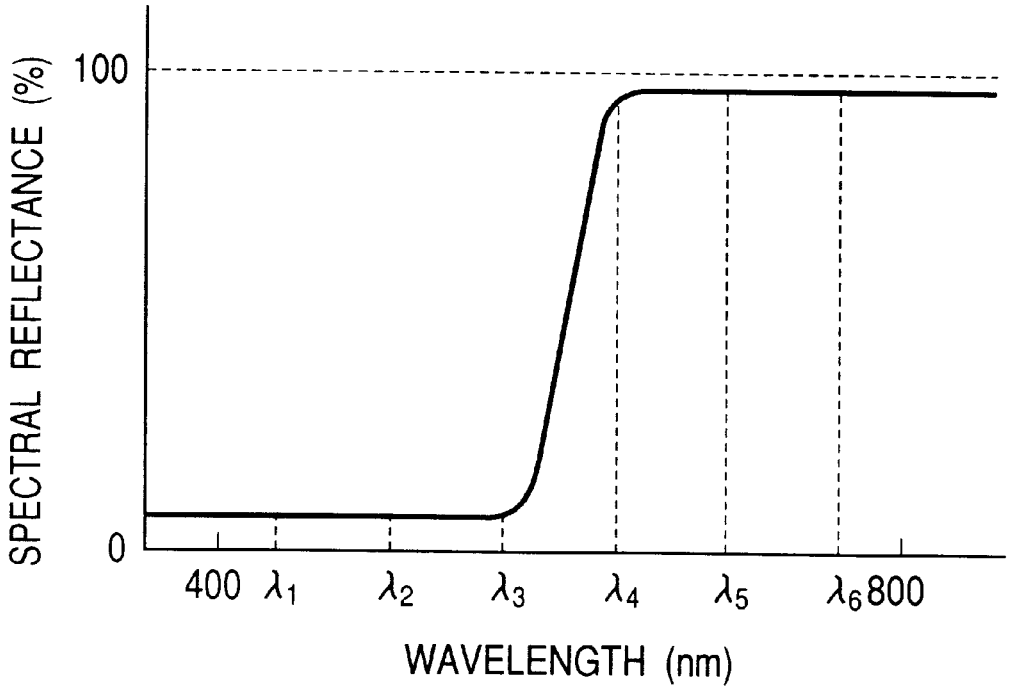
FIG. 2 is a graph illustrating spectral reflectance.

Further, disposed in the film thickness measuring system 39 are an image-forming lens 43 and a dichroic mirror 44 having such a characteristic as shown in FIG. 2 which splits the white light into a first wavelength region including wavelengths $\lambda_i$(i=1 to 3) and a second wavelength region including wavelengths $\lambda_i$(i=4 to 6). Disposed in a reflecting direction of the dichroic mirror 44 is a trichromatic decomposing optical element having CCD light receiving elements 45*a* to 45*c* which are arranged in two dimensions for branching each of the wavelengths $\lambda_i$(i=1 to 3) within the first wavelength region and receiving them. Disposed in a transmitting direction of the dichroic mirror 44 is a similar trichromatic decomposing optical element having CCD light receiving elements 46*a* to 46*c* which are arranged in two dimensions for branching each of the wavelengths $\lambda_i$(i=4 to 6) within the second wavelength region and receiving them.

Figure 3:
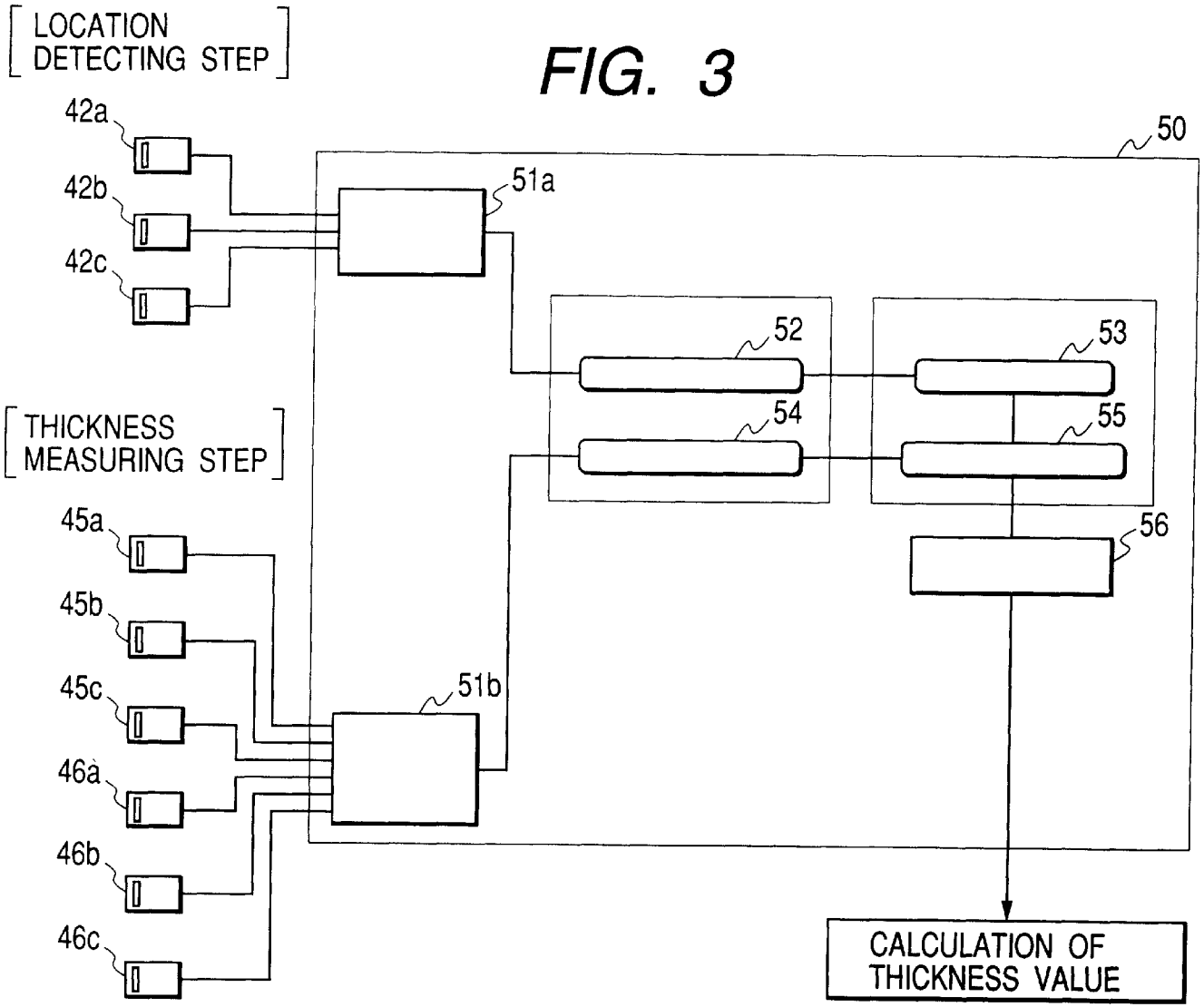
FIG. 3 is a block diagram illustrating information processing steps in a location detecting system and a thickness measuring system.

FIG. 3 is a block diagram illustrating a configuration of a host computer which processes optical signals received by the CCD light receiving elements 42*a* to 42*c*, 45*a* to 45*c* and 46*a* to 46*c*. Outputs from the CCD light receiving elements 42*a* to 42*c* of the location detecting-focusing system 38 are connected consecutively to an image processing board 51*a*, a location detecting image memory 52 of an external storage section and a location detecting image processor 53 of the image processing section in a host computer 50, whereas outputs from the CCD light receiving elements 45*a* to 45*c* and 46*a* to 46*c* of the film thickness measuring system 39 are connected consecutively to an image processing board 51*b*, a film thickness measuring image memory 54 of the external storage section and a film thickness measurement suited location selector 55 of the image processing section in the host computer 50. In the image processing section, the output from the location detecting image processor 53 is connected to the film thickness measurement suited location selector 55, and an output from the film thickness measurement suited location selector 55 is connected to a film thickness measuring arithmetic section 56 to calculate a thickness value.

A light bundle emitted from the momentary white light source is led through the optical fiber 36 into the illumination optical system, wherein the light bundle travels by way of the condenser lens 35, the mirror 34, the half mirror 31 and objective lens 30, and is incident onto the film layer f within the predetermined region of a surface of the substrate W at an incident angle which is nearly a right angle.

A light bundle reflected by a top surface of the film layer f and a light bundle reflected by a bottom surface of the film layer f which is a border between the substrate W and the film layer f are led into the image-forming optical system 37 which comprises the objective lens 30, image-forming lenses 40 and 43. The light bundle which is reflected by the top surface of the film layer f is branched by the half mirror 32 in the image-forming optical system 37, and travels by way of the image-forming lens 40 and the mirror 41 in the location detecting-focusing system 38, and then images are formed on the CCD light receiving elements 42*a* to 42*c* which are arranged in the two dimensions.

Figure 4:
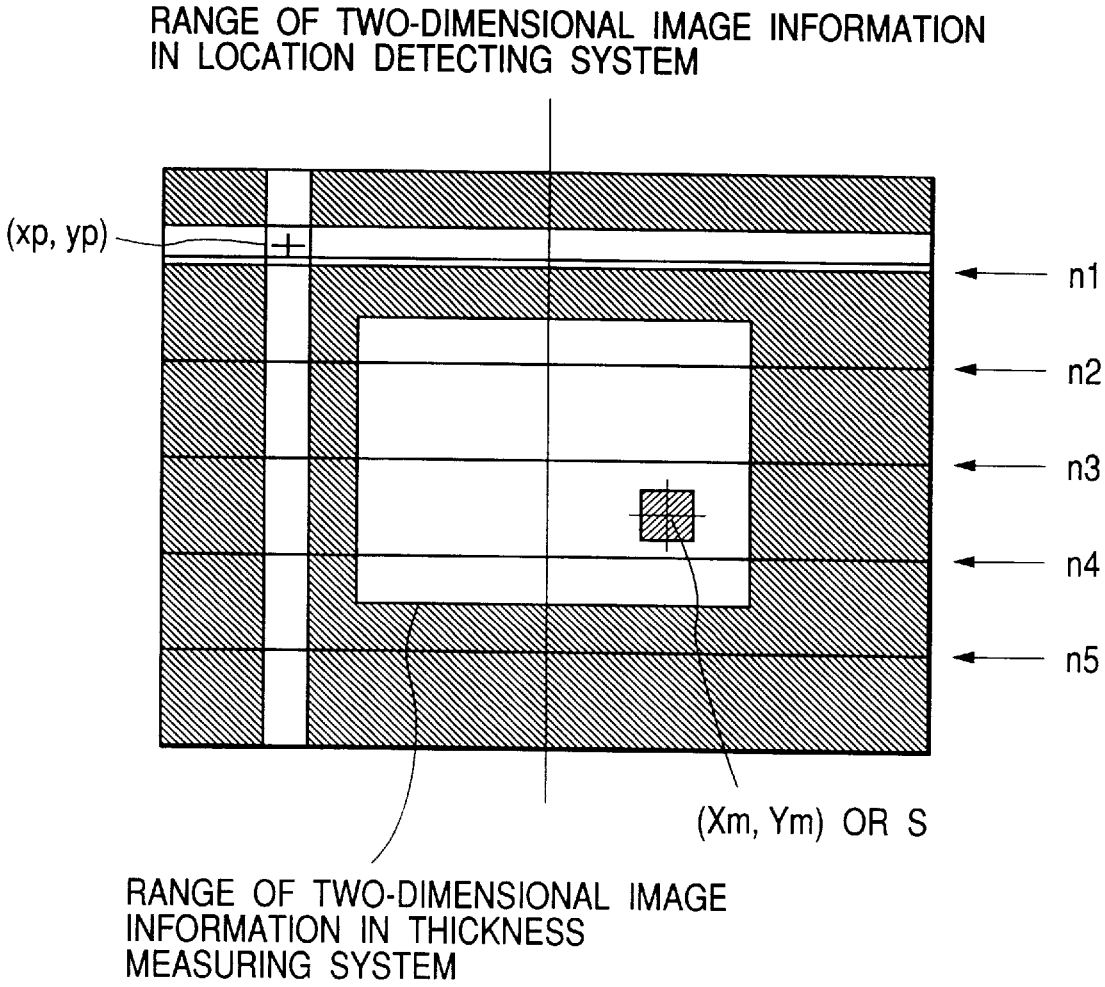
FIG. 4 is a diagram descriptive of an information range of two-dimensional images in the location detecting system.

Two-dimensional images received by the CCD light receiving elements 42*a* to 42*c* are displayed as shown in FIG. 4 and stored into the location detecting image memory 52 in the external storage section of the host computer 50 by way of the image processing board 51*a* for the location detecting step.

In order to discriminate an image which is in an optimum image-formed condition from these two-dimensional images, a plurality of sampling lines n1 to n5 such as those which are shown in FIG. 4 are arranged to determine profiles of received optical signals on image cross-sections. From the profile information of the image cross-sections, the location detecting image processor 53 determines differences between received optical signals for combinations of picture element addresses i and j which are adjacent to each other, and adopts an image which has a maximum average value of the differences as a location detecting image.

Figure 5:
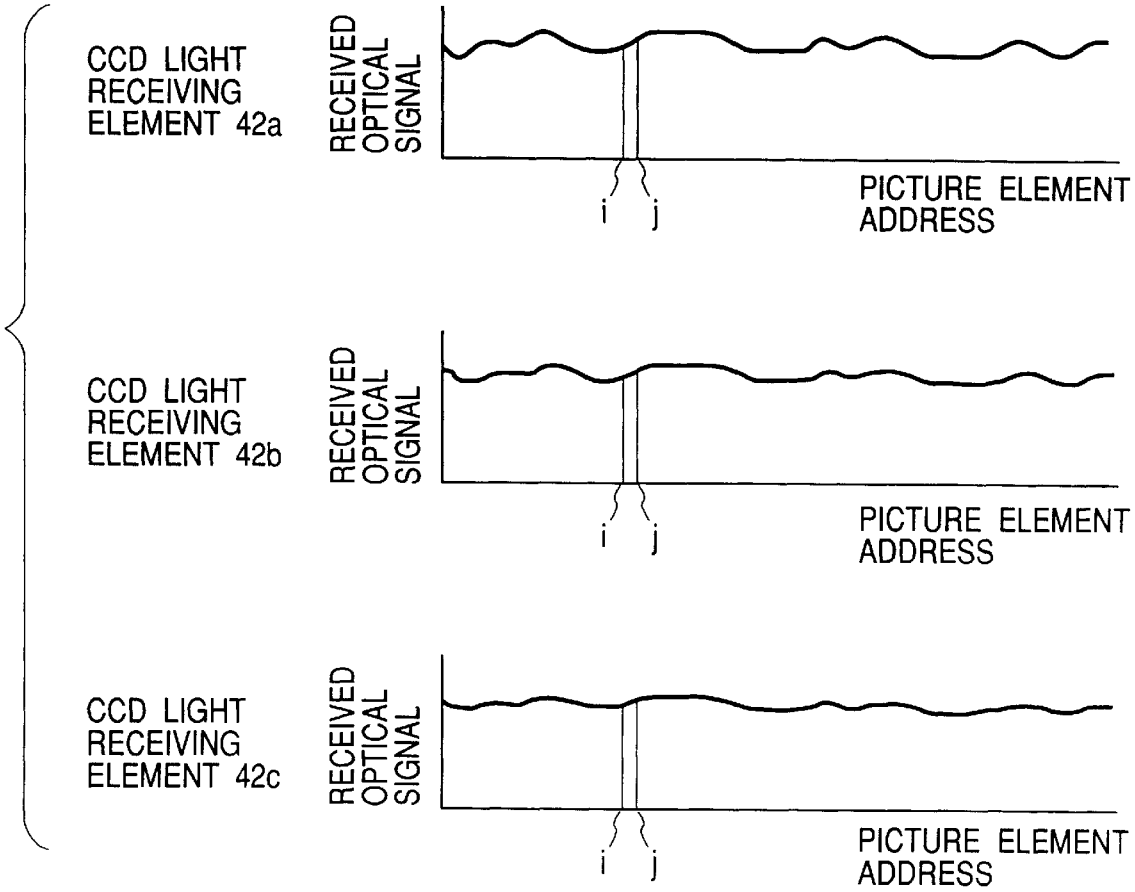
FIG. 5 is diagram illustrating graphs of sampling lines.

FIG. 5 shows profiles of image cross-sections which are displayed on screens of the CCD light receiving elements 42*a* to 42*c* arranged in two dimensions at a plurality of different locations and determined by the sampling line n3. Out of these screens, the location detecting image processor 53 adopts a screen of the CCD light receiving element 42*a* which shows a maximum average value of difference between the received optical signals as described above and determines a location (Xp, Yp) in the screen by taking a preliminarily registered specific pattern or mark such as that shown in FIG. 6 as standard. Since a location (Xm, Ym) or a region S suitable for measuring a film thickness with respect to a location indicated by the specific pattern or mark is preliminarily determined from a distribution of a pattern arrangement on the surface of the substrate W, the thickness measurement suited location selector 55 determines a location (Xm, Ym) or region S suited for thickness measurement on a coordinate system taking this location (Xp, Yp) as standard by image processing.

By configuring an optical system which forms the light bundle coming from the specific region into a two-dimensional image as a telecentric optical system, i.e., an optical system which has at least one of an entrance pupil and an exit pupil located at infinite distance, it is possible to restrain a magnified level of a two-dimensional image from being varied at a plurality of different image-forming locations in the location detection step, thereby preventing selection of a location from being made erroneous due to a magnification change in the step of determining a location suited for film thickness measurement by comparing the preliminarily registered pattern arrangement information on the surface of the substrate with the data of the two-dimensional image informations described above.

Subsequently to the location detection step, the light bundle which has transmitted through the half mirror 32 in the image-forming optical system 37 passes through the image-forming lens 43 in the film thickness measuring system 39, and is branched by the dichroic mirror 44 into the first wavelength region and the second wavelength region. An optical path of the first wavelength region is branched into three wavelengths $\lambda_i$(i=1 to 3), and an optical path of the second wavelength region is branched into the three wavelengths $\lambda_i$(i=4 to 6), respectively, to form images through the trichromatic decomposing optical element on the CCD light receiving elements 45*a* to 45*c* and CCD light receiving elements 46*a* to 46*c*.

The light bundle at each of the wavelengths $\lambda_i$(i=1 to 6) has an interfering spectral reflection intensity which corresponds to a thickness of the film layer f and is specific to each of the wavelengths, and the interfering spectral reflection intensity of each wavelength is stored in a two-dimensional format into the film thickness measuring image memory 54 of the external storage section of the host computer 50 by way of the image processing board 51*b* in the film thickness measurement step.

Then, on the basis of coordinates of the location (Xm, Ym) or region S which is obtained from the two-dimensional image informations stored at the separate wavelengths in the location detection step described above, the film thickness measuring arithmetic section 56 calculates a thickness value from optical signals received by picture elements corresponding thereto.

In a first step, the film thickness measuring arithmetic section 56 calculates a plurality of solutions of a film thickness value at each wavelength using at least three optical signals out of a plurality of optical signals received separately at each of the wavelengths, selects a combination of solutions of the film thickness values which are closest to each other from the plurality of the solutions and determines an approximate film thickness value of the film layer from the selected combination of solutions.

In a second step, a plurality of solutions of the thickness value at each wavelength are calculated by using all the optical signals received separately at each of the wavelengths similarly to the first step, a selection range is restricted taking the approximate film thickness value obtained in the first step as standard, a combination of solutions of the film thickness value having values which are closest to each other is selected from the plurality of solutions to determine a detail film thickness value.

Figure 7:
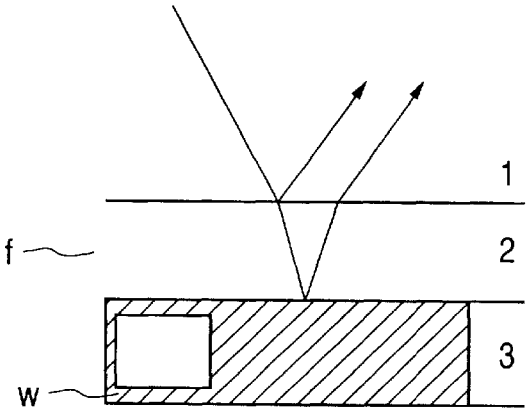
FIG. 7 is a diagram descriptive of reflected light bundles.
Figure 8:
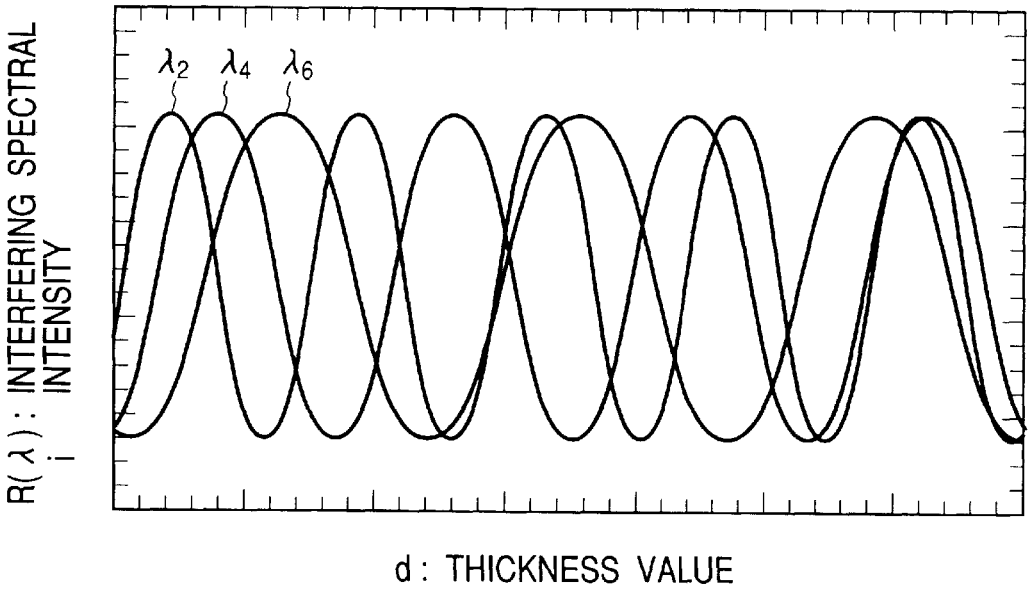
FIG. 8 is a graph illustrating interfering spectral reflection intensities.

FIG. 7 shows a state of the reflected light in the film thickness measurement step, and FIG. 8 shows a graph illustrating relationship between interfering spectral reflection intensities and film thickness values. In a first step, three wavelength $\lambda_2$, $\lambda_4$ and $\lambda_6$ are selected out of the wavelengths $\lambda_i$(i=1 to 6). Interfering spectral reflection intensities at the wavelengths $\lambda_i$(i=2, 4, 6), i.e., standard outputs $R(\lambda_i)$ (i=2, 4, 6) of optical signals received separately at each of the wavelengths, are expressed by the following equation (1):

$$R(\lambda_i)=\{\gamma^2+\rho^2+2\gamma\rho\cos(\phi+\delta)\}/\{1+\gamma^2\rho^2+2\gamma\rho\cos(\phi+\delta)\} \quad (1)$$

wherein

- $\gamma$: Fresnel's reflection coefficient of an interface between an air layer a and the film layer f
- $\rho$: Fresnel's reflection coefficient of an interface between the film layer f and the substrate W
- $\phi$: a phase change due to reflection on the interface between the film layer f and the substrate W
- $\delta$: a phase difference between a light bundle reflected by the interface between the air layer a and the film layer f, and a light bundle reflected by the interface between the film layer f and the substrate W The six wavelengths $\lambda_i$(i=1 to 6) including the three wavelengths selected in this step are set so that variation periods of the standard outputs $R(\lambda_i)$ of the interfering spectral reflection intensities are not overlapped with one another.

From the informations of two-dimensional images measured at these three wavelengths, the film thickness measuring arithmetic section 56 determines a received optical signal $R'(\lambda_i)$ corresponding to a picture element which provides an average value of the image signals at the location (Xm, Ym) or the region S suited for the thickness measurement determined at the location detection step. In order to determine a film thickness value di at each wavelength from this value, a refractive index n of the film layer and an integer N are used to transform the equation (1) into the following equation (2):

$$di=\{\lambda_i/(4\pi n)\}\{-\phi+2N\pi+\cos^{-1}(A/B)\} \quad (2)$$

wherein $A=\gamma^2+\rho^2-(1+\gamma^2\rho^2)R'(\lambda_i)$ $B=2\gamma\rho\{R'(\lambda_i)-1\}$ Dependently on selection of a value of N, a plurality of solutions of a film thickness value $d_{iN}$ may be obtained within a measuring range of the thickness of the film layer f on the surface of the substrate W. Thickness values $d_{iN}$ which are calculated by the thickness measuring arithmetic section 56 using three measured reception optical signals $R'(\lambda_i)$ are tabulated in Table 1 shown below.

TABLE 1

| N | $R'(\lambda_{2N})$ | $R'(\lambda_{4N})$ | $R'(\lambda_{6N})$ |
|---|---|---|---|
| 1 | $d_{21}$ | $d_{41}$ | $d_{61}$ |
| 2 | $d_{22}$ | $d_{42}$ | $d_{62}$ |
| 3 | $d_{23}$ | $d_{43}$ | $d_{63}$ |
| 4 | $d_{24}$ | $d_{44}$ | $d_{64}$ |
| 5 | $d_{25}$ | $d_{45}$ | $d_{65}$ |
| 6 | $d_{26}$ | $d_{46}$ | $d_{66}$ |
| 7 | $d_{27}$ | $d_{47}$ | $d_{67}$ |
| 8 | $d_{28}$ | $d_{48}$ | $d_{68}$ |
| 9 | $d_{29}$ | $d_{49}$ | $d_{69}$ |
| 10 | $d_{210}$ | $d_{410}$ | $d_{610}$ |
| 11 | $d_{211}$ | $d_{411}$ | $d_{611}$ |
| 12 | $d_{212}$ | $d_{412}$ | $d_{612}$ |
| 13 | $d_{213}$ | $d_{413}$ | $d_{613}$ |
| 14 | $d_{214}$ | $d_{414}$ | $d_{614}$ |
| 15 | $d_{215}$ | $d_{415}$ | $d_{615}$ |
| 16 | $d_{216}$ | $d_{416}$ | $d_{616}$ |
| ... | ... | ... | ... |

From $d_{2N}$, $d_{4N}$ and $d_{6N}$ listed in Table 1, a combination thereof which provides a minimum sum of squares of differences therebetween is calculated by the following equation (3):

$$V(a, b, c)=(d_{2a}-d_{4b})^2+(d_{2a}-d_{6c})^2+(d_{4b}-d_{6c})^2 \quad (3)$$

An approximate value of the film thickness to be measured is determined as an average value $(d_{2a}+d_{4b}+d_{6c})/3$ calculated from $d_{2a}$, $d_{4b}$ and $d_{6c}$ which compose the combination having the minimum value of V.

Dependently on a film thickness value $d_i$ to be measured, a measured reception optical signal $R'(\lambda_i)$ may exceed a maximum value or a minimum value of the standard output $R(\lambda_i)$ shown in a graph in FIG. 8. Since it is impossible to calculate the thickness value $d_i$ by using the equation (2) in such a case, the received optical signal $R'(\lambda_i)$ is substituted for the standard output $R(\lambda_i)$ for convenience of calculation. In this first step, a measuring accuracy is low since the film thickness value $d_i$ is determined only at the three wavelengths.

In a second step, the film thickness value $d_i$ is calculated in more detail by increasing a number of wavelengths to six wavelengths $\lambda_i$(i=1 to 6) including the three wavelengths used in the first step of enhance a measuring accuracy, restricting a comparison range by taking the approximate thickness value $d_i$ as a center and carrying out the calculation by the equation (3) in the first step.

When a combination of $d_{2a}$, $d_{4b}$ and $d_{6c}$ minimizes the value of V in the first step, the thickness measuring arithmetic section 56 newly prepares a table of values of $d_{iN}$, as shown in Table 2 below, wherein N with respect to a, b and c is changed within a range of N'=N 2 and wavelengths are increased to six corresponding to those listed in Table 1.

TABLE 2

| N' | $R'(\lambda_{1N})$ | $R'(\lambda_{2N})$ | $R'(\lambda_{3N})$ | $R'(\lambda_{4N})$ | $R'(\lambda_{5N})$ | $R'(\lambda_{6N})$ |
|---|---|---|---|---|---|---|
| N − 2 | $d_{1N-2}$ | $d_{2N-2}$ | $d_{3N-2}$ | $d_{4N-2}$ | $d_{5N-2}$ | $d_{6N-2}$ |
| N − 1 | $d_{1N-1}$ | $d_{2N-1}$ | $d_{3N-1}$ | $d_{4N-1}$ | $d_{5N-1}$ | $d_{6N-1}$ |
| N | $d_{1N}$ | $d_{2N}$ | $d_{3N}$ | $d_{4N}$ | $d_{5N}$ | $d_{6N}$ |
| N + 1 | $d_{1N+1}$ | $d_{2N+1}$ | $d_{3N+1}$ | $d_{4N+1}$ | $d_{5N+1}$ | $d_{6N+1}$ |
| N + 2 | $d_{1N+2}$ | $d_{2N+2}$ | $d_{3N+2}$ | $d_{4N+2}$ | $d_{5N+2}$ | $d_{6N+2}$ |

From Table 2, the thickness measuring arithmetic section 56 calculates an average of values of $d_{1N}$ to $d_{6N}$ which provide a minimum value of V' as a detail value of the film thickness to be measured by using, in place of the equation (3) in the first step, the following equation (4):

$$V'(a', b', c', e', f', g')=(d_{1a}'-d_{2b}')^2+(d_{1a}'-d_{3c}')^2+(d_{1a}'-d_{4e}')^2+(d_{1a}'-d_{5f}')^2+(d_{1a}'-d_{6g}')^2+(d_{2b}'-d_{3c}')^2+(d_{2b}'-d_{4e}')^2+(d_{2b}'-d_{5f}')^2+(d_{2b}'-d_{6g}')^2+(d_{3c}'-d_{4e}')^2+(d_{3c}'-d_{5f}')^2+(d_{3c}'-d_{6g}')^2+(d_{4e}'-d_{5f}')^2+(d_{4e}'-d_{6g}')^2+(d_{5f}'-d_{6g}')^2 \quad (4)$$

Figure 9:
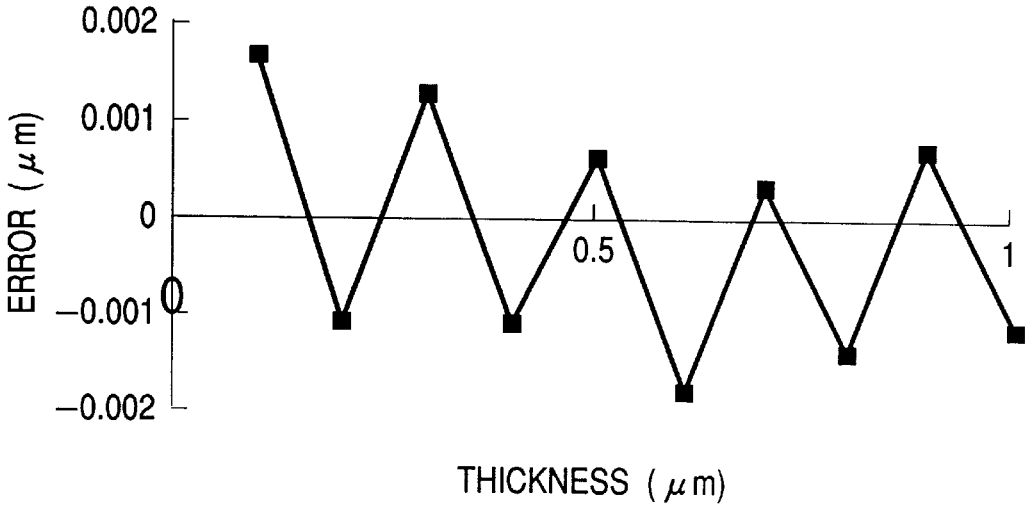
FIG. 9 is a graph illustrating thickness measuring accuracies.
Figure 10:
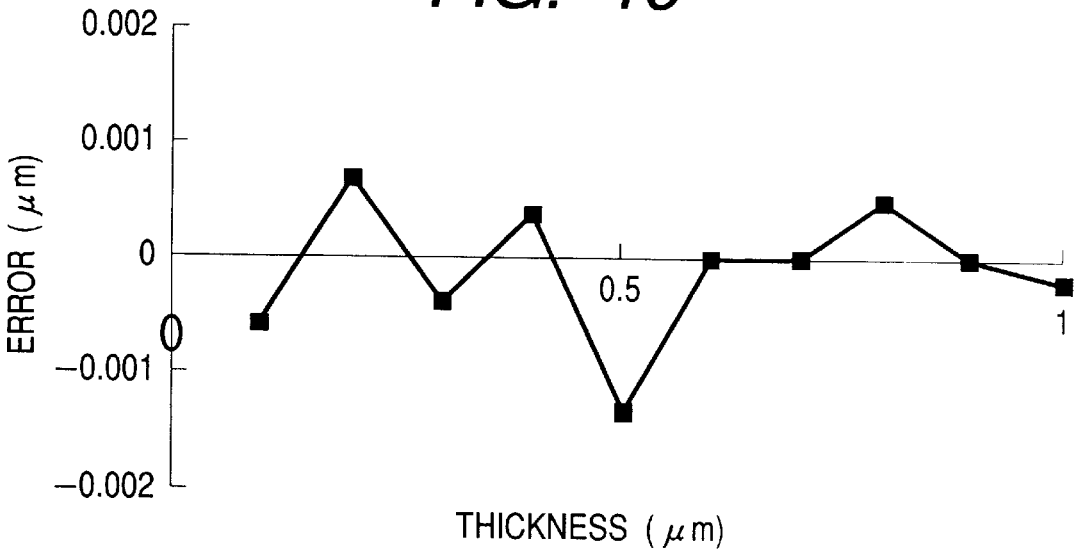
FIG. 10 is a graph illustrating thickness measuring accuracies.

FIGS. 9 and 10 show optical signals $R'(\lambda_i)$ which were received and measured by applying the film thickness measuring processes in the first and second steps described above to a film layer structure consisting of a substrate of Si and a film layer of $SiO_2$, and have errors of 0.2% with respect to the standard output $R(\lambda_i)$. FIG. 9 shows results obtained in the first step and FIG. 10 shows results obtained in the second step. As seen from these drawings, measuring accuracies were enhanced at the second step which uses the increased number of wavelengths. The first and second steps described above make it possible to shorten a time for calculation of a film thickness and measure it with a high accuracy even if a number of wavelengths is increased.

The present embodiment sets an information range of two-dimensional images in the film thickness measuring system within a broad visual field including a location suited for measuring a film thickness and picks up a plurality of images at different focal points with fixed image pickup devices. In the present embodiment, it is possible to easily obtain images in favorably image-forming conditions even when the substrate W is moving relative to the film thickness measuring means, thereby eliminating the necessity to align a measuring location with high precision. Since the present embodiment adopts the light source which emits the momentary light, the present embodiment makes it possible to prevent the two-dimensional images from being shifted laterally and further accurately determine the location (Xm, Ym) or region S suited for measuring the film thickness to measure a film thickness.

Figure 11:
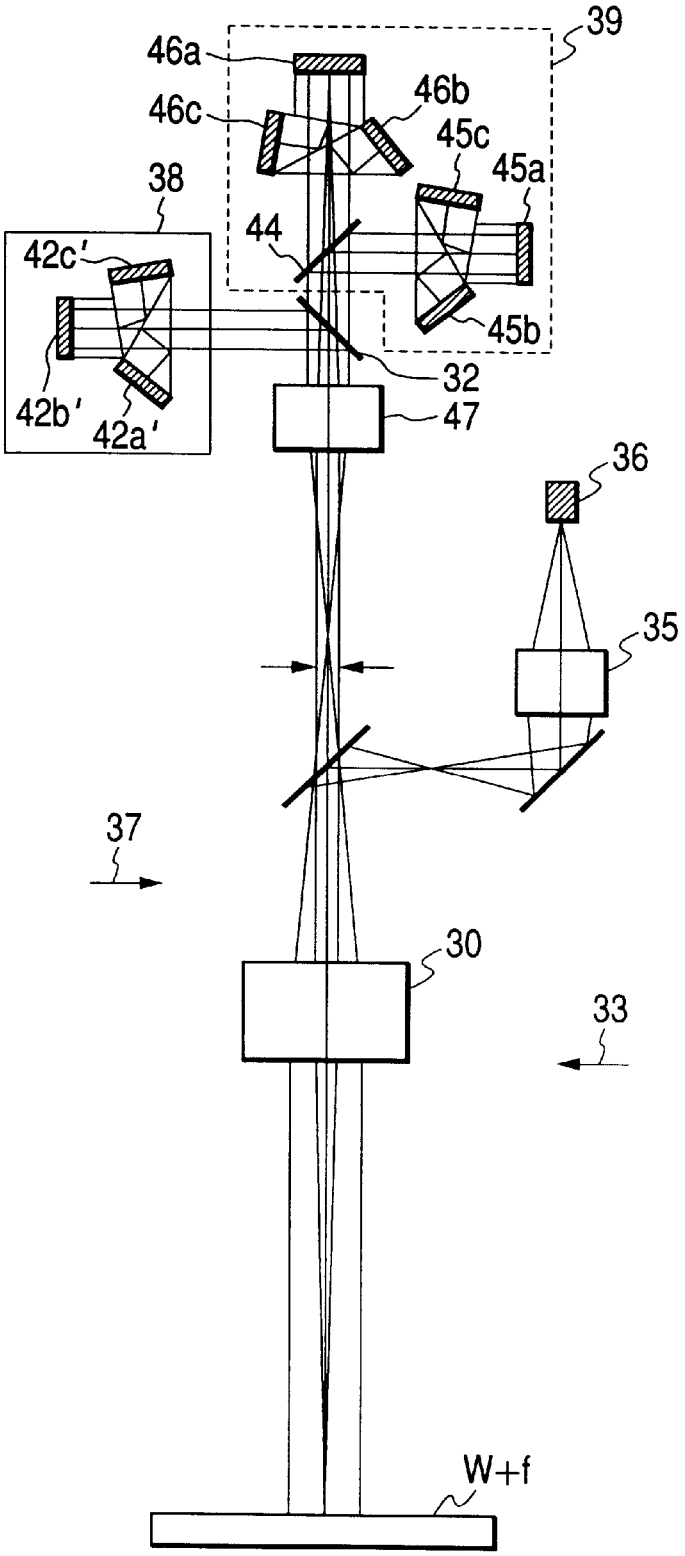
FIG. 11 is a schematic diagram illustrating another configuration of the thickness measuring means according to the present invention by using the spectral reflectance method wherein data ranges of two-dimensional images are equalized.

FIG. 11 shows a modification example of the film thickness measuring means described above, wherein CCD light receiving elements 42*a*' to 42*c*' of the location detecting-focusing system 38 have a size nearly equal to that of CCD light receiving elements 45*a* to 45*c* and 46*a*' to 46*c*' of a film thickness measuring system 39, and an image-forming lens 47 is disposed between half mirrors 31 and 32 in place of the image-forming lenses 40 and 43. Dependently on conditions of pattern arrangement on the substrate W, the information range of two-dimensional images in the location detection step may be nearly equal to that in the film thickness measurement step. In such a case, it is possible to preliminarily register a pattern of a location suited for measuring a film thickness in place of the specific pattern or mark and directly determine a location (Xm, Ym) suited for film thickness measurement by taking this pattern as standard.

The film thickness measuring method according to the present embodiment is effective for, in particular, a film layer in which a pattern is formed. However, it is also applicable to film layers which have no pattern therein.

Figure 12:
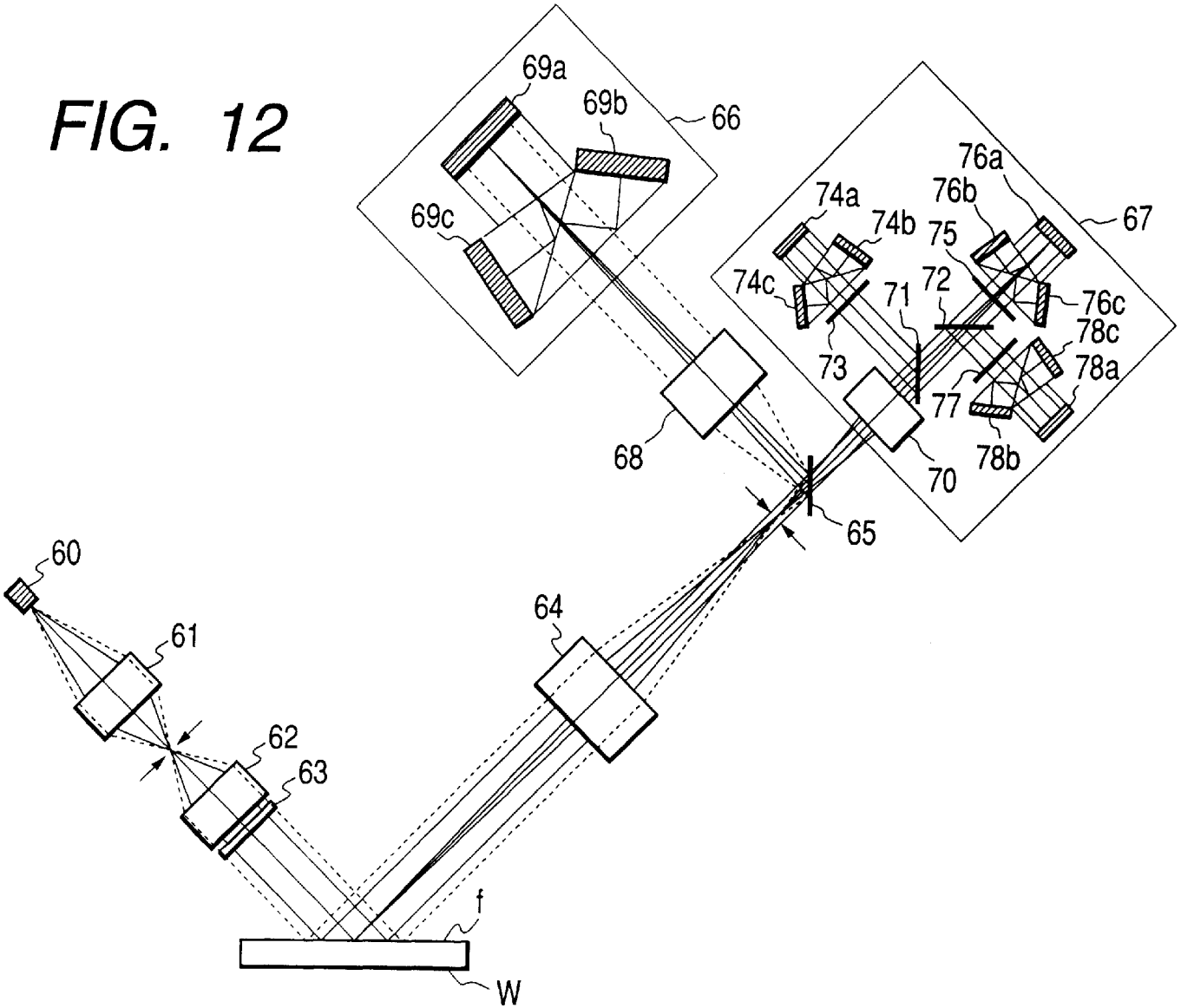
FIG. 12 is a schematic diagram illustrating a configuration of a thickness measuring means according to the present invention by using the polarization analysis method.

FIG. 12 shows a configuration of a film thickness measuring means according to the present invention which utilizes the polarization analysis method, wherein two condenser lenses 61 and 62, and a polarizer 63 which has a polarizing direction of 45 degrees are arranged in an optical path in an oblique direction at an angle of θ relative to a substrate W on which a film layer f is formed. An objective lens 64 and a half mirror 65 are disposed in an optical path which is also oblique relative to the substrate W, a location detecting-focusing system 66 is disposed in a reflecting direction of the half mirror 65, and a film thickness measuring system 67 is disposed in a transmitting direction of the half mirror 65.

The location detecting-focusing system 66 comprises an image-forming lens 68 and CCD light receiving elements 69*a* to 69*c* which are arranged in two dimensions. These CCD light receiving elements 69*a* to 69*c* are fixed at a plurality of different locations, function to select an image which is formed in an optimum condition, and determine a location of the image which is suited for measuring a film thickness. A film thickness measuring system 67 comprises an image-forming lens 70 as well as half mirrors 71 and 72 which branch an optical path in three directions. An analyzer 73 which has an azimuth of 0 degree and CCD light receiving elements 74*a* to 74*c* which compose a trichromatic decomposing optical element for branching a light bundle into three wavelength $\lambda_i$(i=1 to 3) and which are arranged in two dimensions are disposed in a reflecting direction of the half mirror 71. An analyzer 75 which has an azimuth of 45 degrees and CCD light receiving elements 76*a* to 76*c* which compose a similar trichromatic decomposing optical element are disposed in a transmitting direction of the half mirror 72 located at the back of the half mirror 71. An analyzer 77 which has an azimuth of 90 degrees and CCD light receiving elements 78*a* to 78*c* which compose a similar trichromatic decomposing optical element are disposed in a reflecting direction of the half mirror 72.

Figure 13:
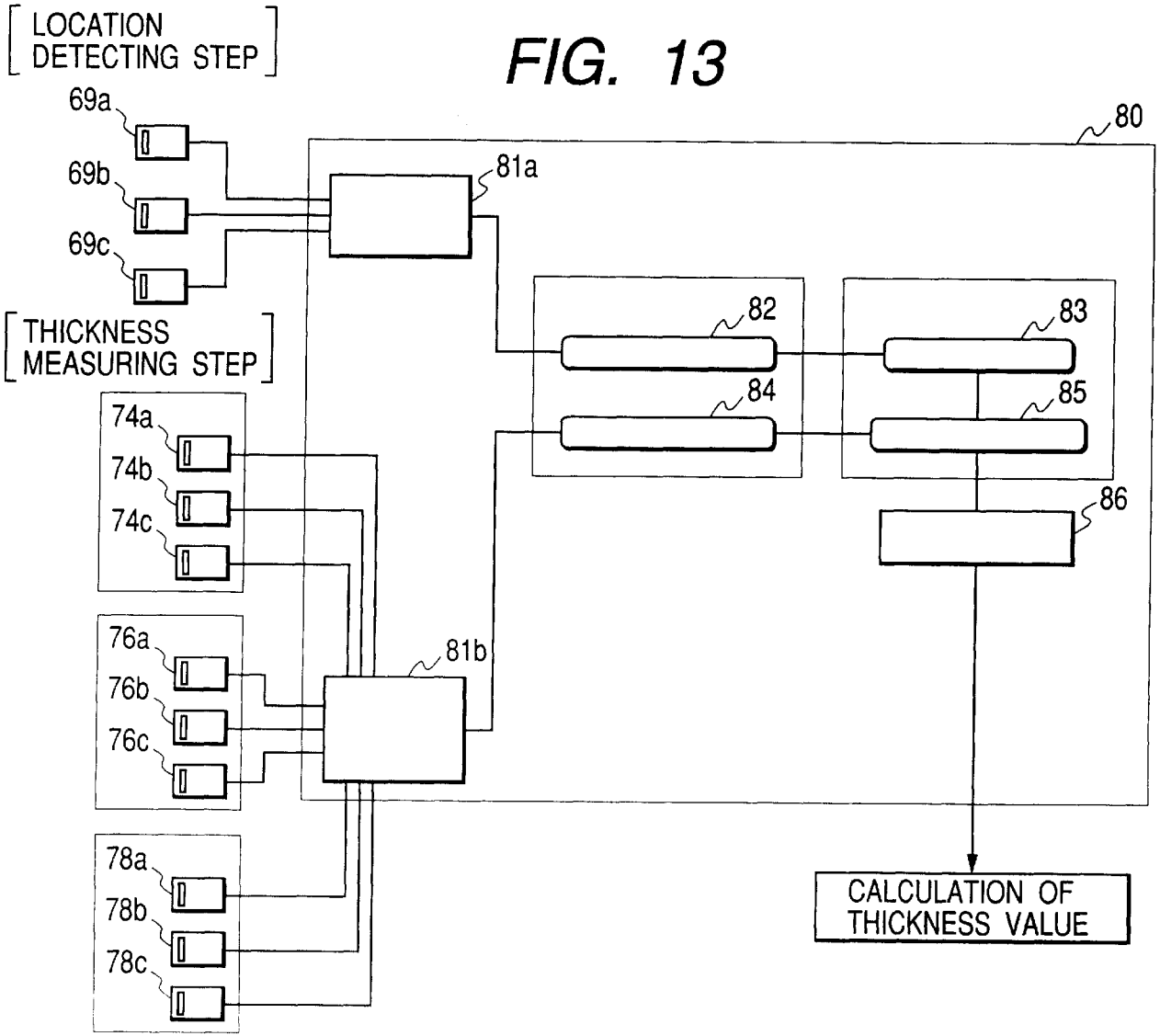
FIG. 13 is a block diagram illustrating information processing steps in a location detecting system and a thickness measuring system.

FIG. 13 shows a configuration of a host computer which processes information of the optical signals received by the CCD light receiving elements 69*a* to 69*c*, 74*a* to 74*c*, 76*a* to 76*c* and 78*a* to 78*c*. Outputs from the CCD light receiving elements 69*a* to 69*c* of the location detecting-focusing system 66 are connected consecutively to an image processing board 81*a*, a location detecting image memory 82 of an external processor section and a position detecting image processor 83 of an image processing section in a host computer 80, whereas outputs from the CCD light receiving elements 74*a* to 74*c*, 76*a* to 76*c* and 78*a* to 78*c* of the film thickness measuring system 67 are connected consecutively to an image processing board 81*b*, a thickness measuring image memory 84 of an external storage section and a thickness measurement suited location selector section 85 of an image processing section in the host computer 80. An output from the location detecting image processor 83 is connected to the film thickness measurement-suitable location selector 85 in an image processing section, and an output from the film thickness measurement-suitable location selector 85 is connected to a film thickness measuring arithmetic section 86 to calculate a film thickness value.

A momentary light emitted from the white light source is led through an optical fiber 60 to an illumination optical system, allowed to pass through condenser lenses 61 and 62, polarized by a polarizer 63 into a linearly polarized light bundle having a polarization azimuth of 45 degrees and incident at an angle θ onto a predetermined region of a substrate W.

A light bundle reflected by the predetermined region of the substrate W which has a film layer f is allowed to pass through an objective lens 64, reflected by a half mirror 65 and formed an image according to the shine proof condition onto the CCD light receiving elements 69*a* to 69*c* which are arranged in the two dimensions. Two dimensional images received by the CCD light receiving elements 69*a* to 60*c* are displayed as shown in FIG. 4 and stored into the location detecting image memory 82 of the external storage section of the host computer 80 by way of the image processing board 81*a* in the location detecting step.

In order to discriminate an image which is formed in an optimum condition, a plurality of sampling lines n1 to n5 are disposed, and an image having a maximum average value of differences in received optical signals between picture element addresses i and j adjacent to each other is adopted as a location detecting image to the location detecting image processor 83, similarly as in the film thickness measuring means by interference spectral reflectance method according to the present invention.

Figure 6:
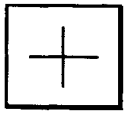
FIG. 6 is a diagram descriptive of a specific pattern or mark.

The location detecting image processor 83 adopts, for example, the image which is received by the CCD light receiving element 69*a* (42*a*) shown in FIG. 5 and determines a location (Xp, Yp) in the two-dimensional image by taking the specific pattern or mark shown in FIG. 6 as standard, and the film thickness measurement-suitable location selector 85 determines a location (Xm, Ym) or a region S on a coordinate system which is suited for the film thickness measurement by taking the location (Xp, Yp) as standard.

Subsequently to the location detecting step, the light bundle which is reflected by the predetermined region of the substrate W is polarized into an elliptically polarized light bundle due to a structure of the film layer f. This elliptically polarized light bundle is allowed to transmit through the objective lens 64 and the half mirror 65, and led to a film thickness measuring system 67 for measuring a film thickness.

In the film thickness measuring system 67, the light bundle is allowed to pass through an image-forming lens 70, is branched by two half mirrors 71 and 72 into three paths, separated in azimuth thereof by analyzers 73, 75 and 77 each having azimuths of 0 degree, 45 degrees and 90 degrees, and imaged onto the CCD light receiving elements 74*a* to 74*c*, 76*a* to 76*c* and 78*a* to 78*c* of the film thickness measuring system 67 which are arranged in the two dimensions according to the shine proof condition by way of a trichromatic decomposing optical element which branches the light bundle into three wavelength $\lambda_i$(i=1 to 3).

The information of two dimensional images which are formed on the CCD light receiving elements 74*a* to 74*c*, 76*a* to 76*c* and 78*a* to 78*c*, respectively, corresponding to the analyzers 73, 75, 77 and the wavelengths $\lambda_i$(i=1 to 3) are stored into the film thickness measuring image memory 84 of the external storage section of the host computer 80 by way of the image processing board 81*b* in the film thickness measuring step.

On the basis of the two dimensional image information and the coordinates of the location (Xm, Ym) or S region suited for the film thickness measurement which is determined in the location detecting step, the film thickness measuring arithmetic section 86 calculates a film thickness value from signals received by picture elements corresponding to the location or region.

In a first step, the film thickness measuring arithmetic section 86 determines a plurality of solutions of the film thickness value by comparing a first correlation table, which represents theoretical relationship between the film thickness value and a ratio in reflection amplitude and a phase difference between P polarized light and S polarized light at each wavelength $\lambda_i$ (i=1 to 3), with a ratio in reflection amplitude and a phase difference between the P polarized light and the S polarized light which are calculated from a plurality of actually measured optical signals at each of the wavelengths, selects a combination of solutions of the thickness value which have values closest to each other from the plurality of solutions, and determines an approximate film thickness value of the film layer f from the selected combination of solutions of the film thickness value.

In a second step, the thickness measuring arithmetic section 86 prepares a second correlation table which represents theoretical relationship among film thickness values, ratios in reflection amplitude and phase differences between the P polarized light and the S polarized light at an interval of the film thickness narrower than that in the first correlation table, restricts a comparison range by taking the approximate film thickness value obtained in the first step as standard, and determines a detail film thickness value by comparing the second correlation table with a ratio in reflection amplitude and a phase difference between the P polarized light and the S polarized light which are calculated from a plurality of actually measured optical signals at each of the wavelengths.

In the first step, the film thickness measuring arithmetic section 86 calculates a ratio in reflection amplitude tan $\Psi_i$ and a phase difference $\Delta_i$ between the P polarized light and the S polarized light from the informations of two-dimensional image which are measured at the three wavelength $\lambda_i$(i=1 to 3) and a value of optical signal corresponding to a picture element having an average value of image signals at the location (Xm, Ym) or region S suited for measuring a film thickness which is determined in the location detection step.

For example, in case of inner wavelength $\lambda_i$, optical signals received by the CCD light receiving elements 74$_a$, 76*a* and 78*a* arranged in the two dimensions in the film thickness measuring system 67 by way of the analyzers having a zimumths of 0 degree, 45 degrees and 90 degrees are defined, respectively, as $I_0$, $I_{45}$ and $I_{90}$. $H_1$ and $H_2$ are represented as follows:

$$H_1=(I_0-I_{90})/(I_0+I_{90})$$

$$H_2=(2\cdot I_{45)/(I0}+I_{90})-1$$

Then, the reflection amplitude ratio tang and the phase difference $\Delta_i$ are expressed by the following formulae respectively:

$$\tan \Psi_i=\{(1+H_1)/(1-H_1)\}^{1/2} \quad (5)$$

$$\Delta_i=\tan^{-1}\{(1-H_1^2-H_2^2)^{1/2}H_2\} \quad (6)$$

The first correlation table representing the theoretical relationship among film thickness values $d_{ik}$, reflection amplitude ratios tan $\Psi_{ik}$ and phase differences $\Delta_{ik}$ between the P polarized light and the S polarized light is shown as following Tables 3 to 5:

TABLE 3

| | | |
|---|---|---|
| $d_{1k}$ | $\tan\Psi_{1k}$ | $\Delta_{1k}$ |
| $d_{11}$ | $\tan\Psi_{11}$ | $\Delta_{11}$ |
| $d_{12}$ | $\tan\Psi_{12}$ | $\Delta_{12}$ |
| $d_{13}$ | $\tan\Psi_{13}$ | $\Delta_{13}$ |
| $d_{14}$ | $\tan\Psi_{14}$ | $\Delta_{14}$ |
| $d_{15}$ | $\tan\Psi_{15}$ | $\Delta_{15}$ |
| $d_{16}$ | $\tan\Psi_{16}$ | $\Delta_{16}$ |
| $d_{17}$ | $\tan\Psi_{17}$ | $\Delta_{17}$ |
| $d_{18}$ | $\tan\Psi_{18}$ | $\Delta_{18}$ |
| $d_{19}$ | $\tan\Psi_{19}$ | $\Delta_{19}$ |
| $d_{110}$ | $\tan\Psi_{110}$ | $\Delta_{110}$ |
| . | . | . |
| . | . | . |
| . | . | . |

TABLE 4

| | | |
|---|---|---|
| $d_{2k}$ | $\tan\Psi_{21}$ | $\Delta_{2k}$ |
| $d_{21}$ | $\tan\Psi_{22}$ | $\Delta_{21}$ |
| $d_{22}$ | $\tan\Psi_{23}$ | $\Delta_{22}$ |

TABLE 4-continued

| | | |
|---|---|---|
| $d_{23}$ | $\tan\Psi_{23}$ | $\Delta_{23}$ |
| $d_{24}$ | $\tan\Psi_{24}$ | $\Delta_{24}$ |
| $d_{25}$ | $\tan\Psi_{25}$ | $\Delta_{25}$ |
| $d_{26}$ | $\tan\Psi_{26}$ | $\Delta_{26}$ |
| $d_{27}$ | $\tan\Psi_{27}$ | $\Delta_{27}$ |
| $d_{28}$ | $\tan\Psi_{28}$ | $\Delta_{28}$ |
| $d_{29}$ | $\tan\Psi_{29}$ | $\Delta_{29}$ |
| $d_{210}$ | $\tan\Psi_{210}$ | $\Delta_{210}$ |
| . | . | . |
| . | . | . |
| . | . | . |

TABLE 5

| | | |
|---|---|---|
| $d_{3k}$ | $\tan\Psi_{3k}$ | $\Delta_{3k}$ |
| $d_{31}$ | $\tan\Psi_{31}$ | $\Delta_{31}$ |
| $d_{32}$ | $\tan\Psi_{32}$ | $\Delta_{32}$ |
| $d_{33}$ | $\tan\Psi_{33}$ | $\Delta_{33}$ |
| $d_{34}$ | $\tan\Psi_{34}$ | $\Delta_{34}$ |
| $d_{35}$ | $\tan\Psi_{35}$ | $\Delta_{35}$ |
| $d_{36}$ | $\tan\Psi_{36}$ | $\Delta_{36}$ |
| $d_{37}$ | $\tan\Psi_{37}$ | $\Delta_{37}$ |
| $d_{38}$ | $\tan\Psi_{38}$ | $\Delta_{38}$ |
| $d_{39}$ | $\tan\Psi_{39}$ | $\Delta_{39}$ |
| $d_{310}$ | $\tan\Psi_{310}$ | $\Delta_{310}$ |
| . | . | . |
| . | . | . |
| . | . | . |

By comparing the values of the reflection amplitude ratio tan $\Psi_i$ and the phase difference $\Delta_i$ between the P polarized light and the S polarized light which are calculated by the formulae (5) and (6) from optical signals received as measured values with the values of the reflection amplitude ratio tan $\Psi_{ik}$ and the phase difference $\Delta_{ik}$ between the P polarized light and the S polarized light which are listed in Tables 3 to 5, the former values closer to the latter values of tan $\Psi_{ik}$ and $\Delta_{ik}$ are determined from a combination which reduce differences between the former values and the latter values by $T_1$, $T_2$, and $T_3$ expressed by the following formulae:

$$T_1(K)=(\tan \Psi_1-\tan \Psi_{1k})^2+(\Delta_1-\Delta_{1k})^2 \quad (7)$$

$$T_2(K)=(\tan \Psi-\tan \Psi_{2k})^2+(\Delta_2-\Delta_{2k})^2 \quad (8)$$

$$T_3(K)=(\tan \Psi_3-\tan \Psi_{3k})^2+(\Delta_3-\Delta_{3k})^2 \quad (9)$$

A plurality of combinations can be considered as those which reduce the differences between the values. When film thickness values which correspond to the plurality of combinations are represented by $d_{1a}$, $d_{2b}$, $d_{3c}$ respectively, a combination which minimizes a sum of squares of differences between $d_{1a}$, $d_{2b}$, and $d_{3c}$ is determined by the following formula (10):

$$V(a, b, c)=(d_{1a}-d_{2b})^2+(d_{1a}-d_{3c})^2+(d_{2b}-d_{3c})^2 \quad (10)$$

From $d_{1a}$, $d_{2b}$, and $d_3$ which minimize a value of V, an average value $(d_{1a}+d_{2b}+d_{3c})/3$ is determined as an approximate value of a thickness to be measured. In this first step, a measuring accuracy is low since the value of the thickness is determined from the correlation table in which the thickness values are selected at certain wide intervals.

In order to enhance the measuring accuracy in a second step, a second correlation table is prepared which represents theoretical relationship among film thicknesses, reflection amplitude ratios tan $\Psi_{ik}$ and phase differences $\Delta_{ik}$ between the P polarized light and the S polarized light at each of wavelengths selected with intervals narrower than those in the first correlation table by taking the approximate film thickness value $d_a$ obtained in the first step as standard. The second correlation table prepared by taking the thickness value $d_a$ obtained in the first step as standard is shown below in Tables 6 to 8:

TABLE 6

| | | |
|---|---|---|
| $d_{k'}$ | $\tan\Psi_{1k'}$ | $\Delta_{1k'}$ |
| $d_a - \epsilon$ | $\tan\Psi_{1a} - \epsilon$ | $\Delta_{1a} - \epsilon$ |
| . | . | . |
| . | . | . |
| . | . | . |
| $d_a$ | $\tan\Psi_{1a}$ | $\Delta_{1a}$ |
| . | . | . |
| . | . | . |
| . | . | . |
| $d_a + \epsilon$ | $\tan\Psi_{1a} + \epsilon$ | $\Delta_{1a} + \epsilon$ |

TABLE 7

| | | |
|---|---|---|
| $d_{k'}$ | $\tan\Psi_{2k'}$ | $\Delta_{2k'}$ |
| $d_a - \epsilon$ | $\tan\Psi_{2a} - \epsilon$ | $\Delta_{2a} - \epsilon$ |
| . | . | . |
| . | . | . |
| . | . | . |
| $d_a$ | $\tan\Psi_{2a}$ | $\Delta_{2a}$ |
| . | . | . |
| . | . | . |
| . | . | . |
| $d_a + \epsilon$ | $\tan\Psi_{2a} - \epsilon$ | $\Delta_{2a} + \epsilon$ |

TABLE 8

| | | |
|---|---|---|
| $d_{k'}$ | $\tan\Psi_{3k'}$ | $\Delta_{3k'}$ |
| $d_a - \epsilon$ | $\tan\Psi_{3a} - \epsilon$ | $\Delta_{3a} - \epsilon$ |
| . | . | . |
| . | . | . |
| . | . | . |
| $d_a$ | $\tan\Psi_{3a}$ | $\Delta_{3a}$ |
| . | . | . |
| . | . | . |
| . | . | . |
| $d_a + \epsilon$ | $\tan\Psi_{3a} + \epsilon$ | $\Delta_{3a} + \epsilon$ |

Taking the approximate film thickness value $d_a$ obtained in the first step as standard, the range $d_k$ of the film thickness range as a comparison range is restricted, for example, to $d_a \pm \epsilon$. The values of the reflection amplitude ratios tang and phase differences $\Delta_i$ between the P polarized light and the S polarized light at each of wavelengths which are calculated from the reception optical signals obtained as actually measured values are compared with the reflection amplitude ratios tan $\Psi_{ik}$, and the phase differences $\Delta_{ik}$, at each of wavelengths in the second correlation table shown in Tables 6 to 8, and the former values of tan $\Psi_i$ and $\Delta_i$ which are closer to the latter values of tan $\Psi_{ik}$, and $\Delta_{ik}$, are determined from a combination which minimizes differences between the values by using $T_1'$, $T_2'$ and $T_3'$:

$$T_1'(k')=(\tan\Psi_1-\tan\Psi_{1k'})^2+(\Delta_1-\Delta_{1k'})^2 \quad (11)$$

$$T_2'(k')=(\tan\Psi_2-\tan\Psi_{2k'})^2+(\Delta_2-\Delta_{2k'})^2 \quad (12)$$

$$T_3'(k')=(\tan\Psi_3-\tan\Psi_{3k'})^2+(\Delta_3-\Delta_{3k'})^2 \quad (13)$$

A plurality of combinations may be considered as those which minimize the difference between the values. When film thickness values corresponding to the plurality of combinations are represented by $d_{1a}'$, $d_{2b}'$ and $d_{3c}'$ respectively, a combination which minimizes a total of squares of differences between $d_{1a}'$, $d_{2b}'$ and $d_{3c}'$ is determined by the following formula:

$$V'(a', b', c')=(d_{1a}'-d_{2b}')^2+(d_{1a}'-d_{3c}')^2+(d_{2b}'-d_{3c}')^2 \quad (14)$$

Using $d_{1a}'$, $d_{2b}'$ and $d_{3c}'$ which minimize a value of V', an average value $(d_{1a}'+d_{2b}'+d_{3c}')$ is calculated as a detail value of a film thickness to be measured.

Figure 14:
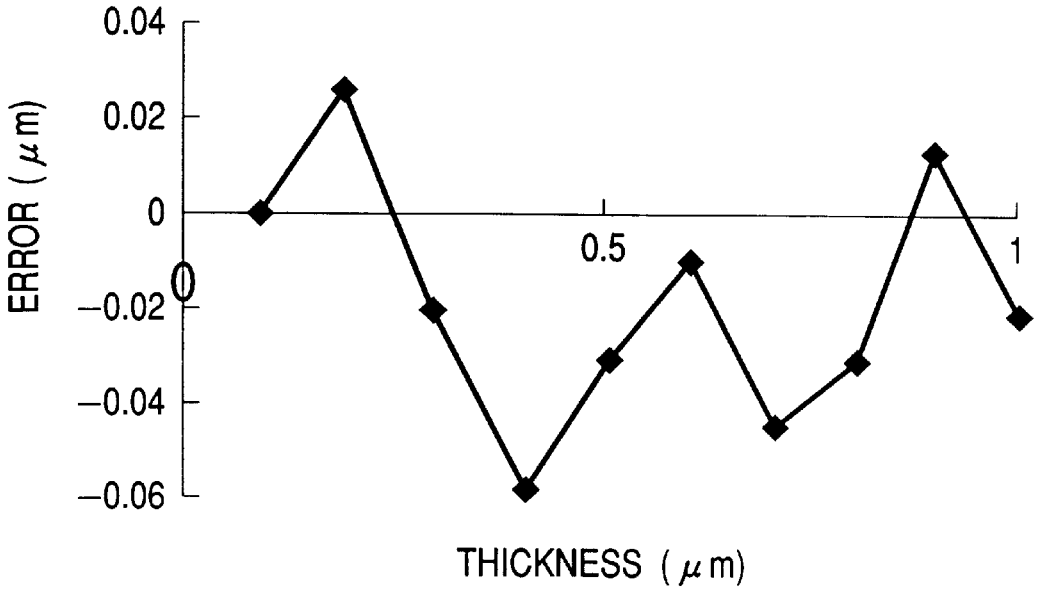
FIG. 14 is a graph illustrating thickness measuring accuracies.
Figure 15:
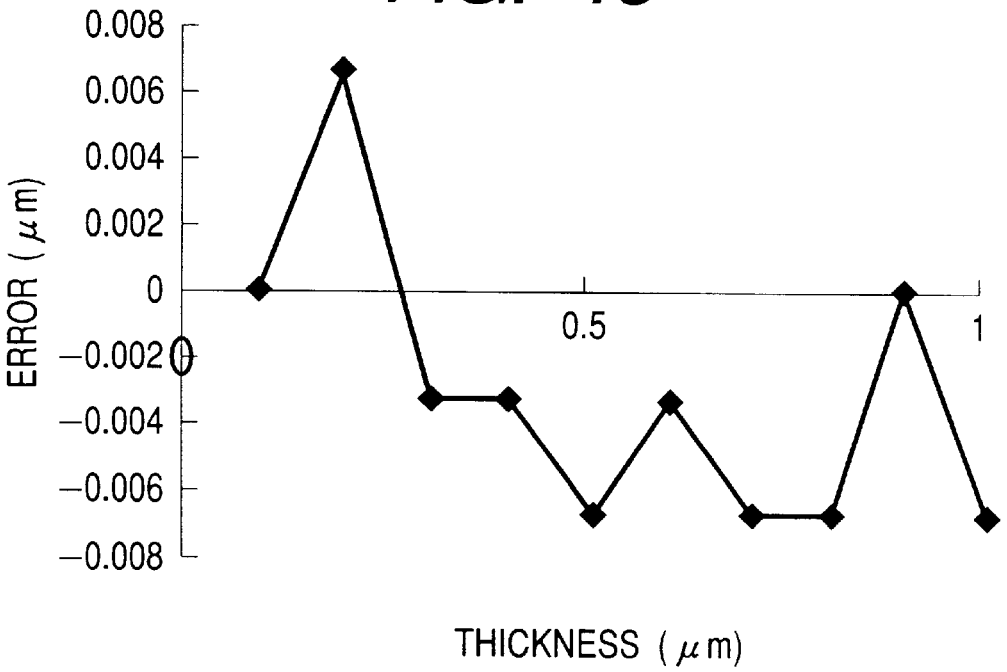
FIG. 15 is a graph illustrating thickness measuring accuracies.

FIG. 14 shows measured results of a film thickness of a sample composed of a substrate W made of Si and a film layer f made of $SiO_2$, which are obtained in the first step, whereas FIG. 15 shows measured results of the film thickness at an increased number of wavelengths than that in the case of FIG. 14, which are obtained in the second step. FIG. 14 shows measuring accuracy results in cases where measured reception optical signals $I_0$, $I_{45}$ and $I_{90}$ have measuring errors of 0.2% each with respect to the standard outputs of the reception optical signals by applying the first and the second steps described above to a film layer structure composed of a substrate of Si and a film layer of $SiO_2$. FIG. 14 shows results obtained in the first step and FIG. 15 shows results at the second step.

It will be understood from these drawings that measuring accuracies are improved in the second step which uses the increased number of wavelengths.

The first and second steps described above make it possible to shorten a time required for calculating a film thickness and measure a film thickness with a high accuracy.

The film thickness measuring means according to the present invention sets a two-dimensional image information range of the film thickness measuring system within a wide visual field including a location suited for measuring a film thickness and, in addition, a plurality of images are picked up in different focal points at a time by fixed image pickup devices. Accordingly, it is possible to obtain an image which is formed in a favorable condition easily and in a short time even when the substrate W is moving relatively to the film thickness measuring means, thereby eliminating the necessity to align a measuring location with high precision. The film thickness measuring means according to the present invention which adopts the illumination system using the momentary light source further prevents a two-dimensional image from being shifted laterally, and a range of the location (Xm, Ym) or region S suited for a film thickness measurement is accurately determined to measure the film thickness.

Figure 16:
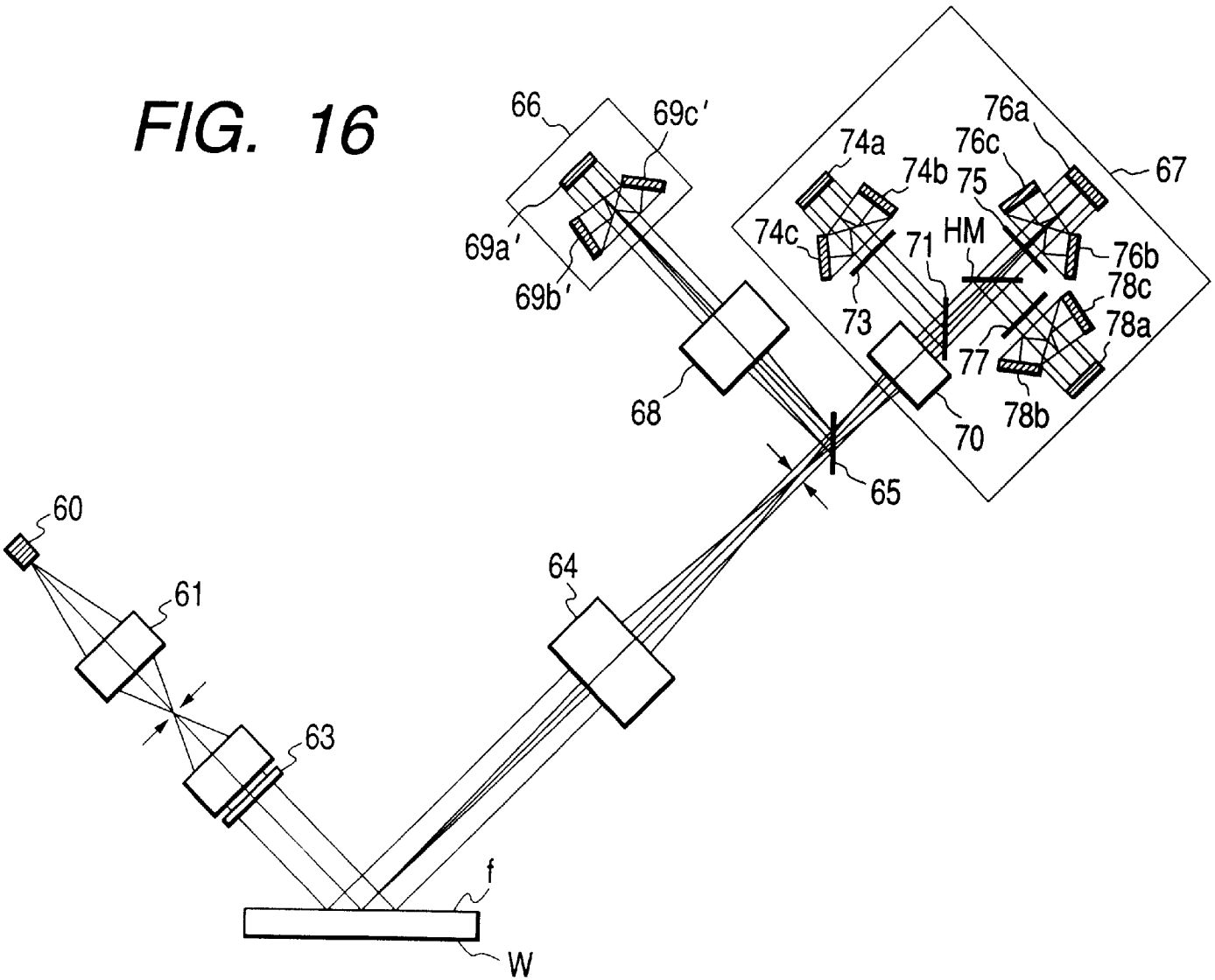
FIG. 16 is a schematic diagram illustrating another configuration of the thickness measuring means according to the present invention by using the polarization analysis method wherein information ranges of two-dimensional images are equalized.

FIG. 16 shows a modification example of the film thickness measuring means according to the present invention which uses the polarized light analysis method, wherein CCD light receiving elements 69*a*' to 69*c*' of a location detecting-focusing system 66 have a size which is nearly equal to that of CCD light receiving elements 74*a* to 74*c* and 76*a* to 76*c* of a film thickness measuring system 67. Depending on conditions of a pattern arrangement on a substrate W, a two-dimensional image information range in the location detecting step may be nearly equal to that in the film thickness measuring step. In such a case, it is possible to preliminarily register a pattern of a location itself which is suited for measuring a film thickness in place of a specific pattern or mark and directly determine a location (Xm, Ym) suited for measuring a film thickness by taking the pattern of the location as standard.

Though the film thickness measuring method according to the present invention is effective for, in particular, measuring the thickness of a film layer on which a pattern is formed, it is also applicable to a film layer on which no pattern is formed.

Now, description will be made on the preferred embodiments of the polishing apparatus according to the present invention.

First Embodiment

Figure 17A:
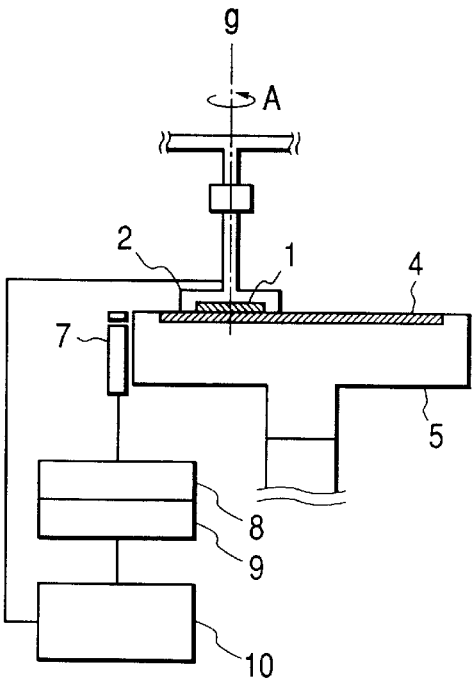
FIGS. 17A and 17B are schematic diagrams showing a first embodiment of the polishing apparatus according to the present invention.
Figure 17B:
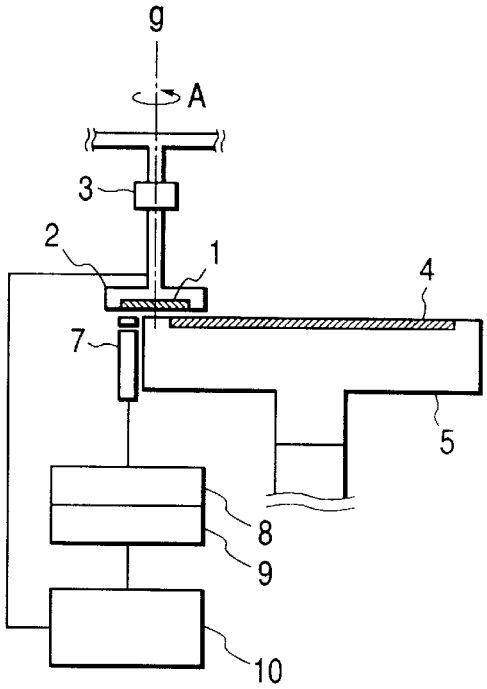

A polishing apparatus according to a first embodiment of the present invention is characterized in that it comprises, as illustrated in FIGS. 17A and 17B, a holding means 2 for a material to be polished which holds a material to be polished (substrate) 1, a first driving means 3 which rotates the holding means 2 for the material to be polished, a polishing head 5 which holds a polishing pad 4 made of a polyurethane opposite to a surface to be polished of the material to be polished 1, a thickness measuring means 7 which measures the surface to be polished of the material to be polished 1 by using the spectral reflection method described above, a location detecting processing section 8, a thickness measuring arithmetic section 9 and a polishing control means 10.

The holding means 2 for the material to be polished rotates around an axis g in a direction indicated by an arrow A. Further, the thickness measuring means 7 is electrically connected to a white light source (not shown in the drawings) which emits a momentary light bundle at a desired timing.

The material to be polished 1 is brought into contact with the polishing pad 4 for polishing. A rotational frequency of the holding means 2 for the material to be polished is set within a range from several to hundreds of rounds per minute or a range exceeding a thousand rounds per minute.

The material to be polished 1 is moved right over the thickness measuring means 7 during polishing. This station is shown in FIG. 17B. The holding means 2 for the material to be polished rotates continuously right over the thickness measuring means 7. At this time, the white light source which emits momentary rays projects momentary light bundle to the surface to be polished of the material to be polished 1 at a predetermined timing. The thickness measuring means 7 picks up an image of the surface to be polished by using the momentary light bundle. The location detecting processing section 8 and the thickness measuring arithmetic section 9 are capable of detecting a location suitable for measuring the thickness of the material to be polished and measuring the thickness of the material simultaneously on the basis of the picked up image of the surface to be polished. The location detecting method and the thickness measuring method have already been described above. Polishing is terminated when no necessity to polish the surface once again is judged. When it is necessary to polish the surface once again, conditions for obtaining a desired thickness value by polishing the surface once again, i.e., a polishing time, a pressure to bring the material to be polished into contact with the polishing pad, etc., are adequately modified on the basis of a measured thickness value. After the modifications of the polishing conditions, the material to be polished 1 is moved by a swinging means 16 over the polishing pad 4, brought into contact with the polishing pads once again and is polished.

In the first embodiment of the present invention, it is preferable to keep the material to be polished apart from the polishing pad 4 during the measurement of the thickness of the material to be polished so that the thickness is not changed by polishing during the measurement.

According to the present invention, the thickness of the polished material may be measured by spectral reflectance method as described in the first embodiment but also, for example, by the modified analysis method described above.

Further, the present invention is not limited to the first embodiment wherein the surface to be polished of the material to be polished 1 is held by the holding means 2 for the material to be polished so as to face downward and the polishing pad 4 is held by the polishing head 5 so as to oppose to the surface to be polished of the material to be polished 1, but may be configured, for example, so that the surface to be polished of the material to be polished is held so as to face upward and the polishing pad 4 is held over the material to be polished 1 so as to oppose to the surface to be polished of the material to be polished 1.

Though the polishing pad 4 is made of polyurethane as described in a first embodiment of the present invention, polyurethane may be foamed polyurethane, porous polyurethane or polyurethane having a high density and a high stiffness. Further, the polishing pad 4 used in the polishing apparatus according to the present invention may be made of a material other than polyurethane, for example, teflon or the like.

Materials to be polished by the polishing apparatus according to the present invention include, for example, nearly circular SOI substrates, semiconductor wafers made of Si, GaAs, InP and the like and wafers having insulating films or metal films formed thereon in the courses of forming semiconductor integrated circuits. The wafers (materials to be polished) which are mentioned above may have a diameter not shorter than approximately 6 inches or 12 inches. Furthermore, the material to be polished 1 is not necessarily circular. The material to be polished according to the present invention includes, for example, substrates for rectangular displays.

Second Embodiment

Figure 18A:
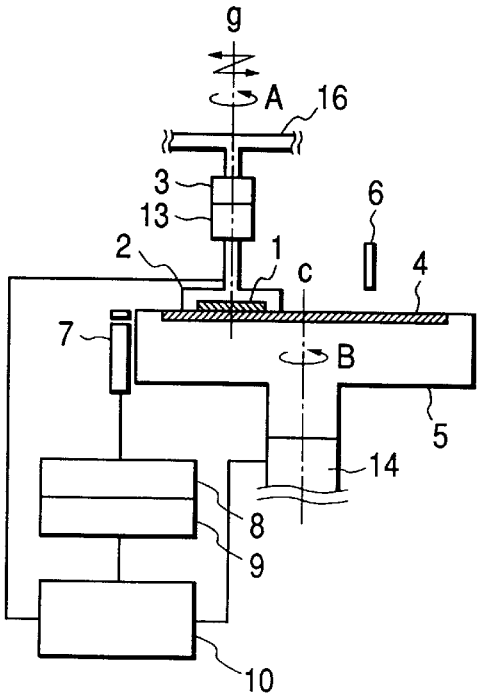
FIGS. 18A, 18B, 18C and 18D are schematic diagrams showing a second embodiment of the polishing apparatus according to the present invention.
Figure 18B:
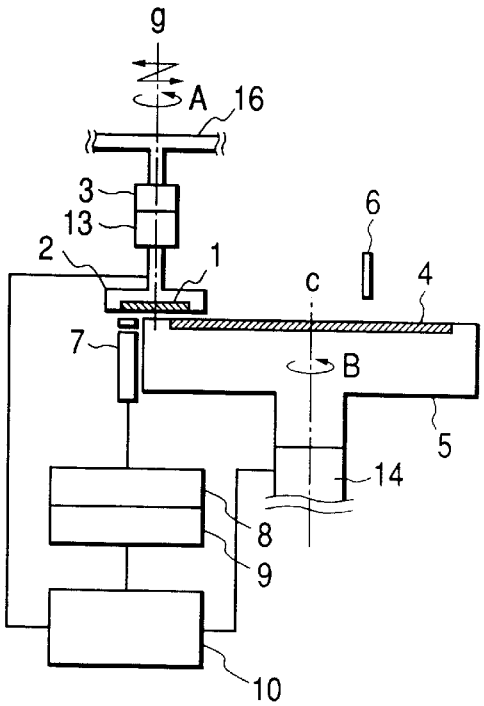

A polishing apparatus according to a second embodiment of the present invention is characterized in that it comprises, as shown in FIGS. 18A and 18B, a holding means 2 for a material to be polished which holds a surface to be polished of a material to be polished (substrate) 1 so as to face downward, a rotary encoder 3 which controls rotation of the holding means 2 for the material to be polished, a polishing head 5 which holds a polishing pad 4 having a diameter larger than that of the material to be polished 1 so as to oppose to the surface to be polished of the material to be polished 1, a slurry supply means 6 which supplies a slurry into a gap between the material to be polished 1 and the polishing pad 4, a thickness measuring means 7 which is disposed beside the polishing head 5 to measure the surface to be polished of the material to be polished 1 by the spectral transmittance method described above, a location detecting processor section 8, a thickness measuring arithmetic section 9 and a polishing control means 10. The second embodiment is the same as the first embodiment in other respects.

Figure 18C:
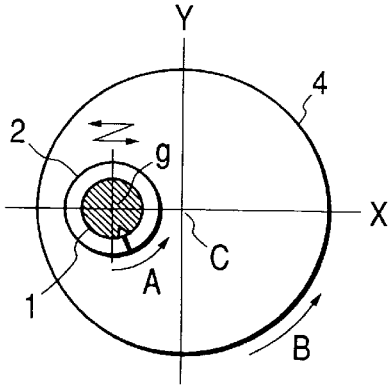
Figure 18D:
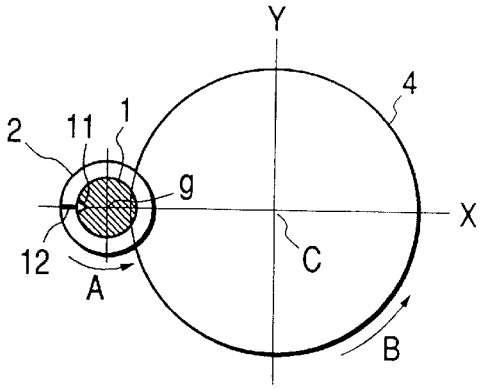

Further, FIGS. 18C and 18D are schematic top views of the polishing pad 4 and the holding means 2 for the material to be polished used in the second embodiment of the polishing apparatus according to the present invention.

The material to be polished 1 is held by the holding means 2 for the material to be polished so that a notch 11 of the material to be polished 1 is aligned with a standard mark 12 provided on the holding means 2 for the material to be polished as shown in FIG. 18D.

The holding means 2 for the material to be polished has a first driving means 13 which rotates the means 2 around an axis g in a direction indicated by an arrow A. Further, the polishing head 5 also has a second driving means 14 which rotates the polishing head 5 around an axis C in a direction indicated by an arrow B. Prior to start of polishing, the holding means 2 for the material to be polished is positioned so that the standard mark 12 is set on a side opposite to the axis C of the polishing head 4 with regard to the axis g of the holding means 2 for the material to be polished while the axis g is kept on an X axis out of X and Y axes which are perpendicular to the axis C of the polishing head 5.

The rotary encoder 3 is set so that it is located at angular position of 0 degree, i.e., an origin in this condition. The rotary encoder 3 is electrically connected to a white light source (not shown in the drawings) which emits momentary rays so that the white light source emits momentary rays at the angular position of 0 degree.

The holding means 2 for the material to be polished 1 has a vertical driving means 15 which brings the material to be polished 1 into contact over an entire surface thereof with the polishing pad 4 to polish the surface. At this time, the slurry supply means 6 supplies a slurry between the material to be polished 1 and the polishing pad 4 which are kept in contact with each other. It is preferable to set rotational frequencies of the holding means 2 for the material to be polished and the polishing head at the same level though these frequencies can be set independently within a range from several to hundreds rounds per minute or a range not lower than a thousand rounds per minute. The holding means 2 for the material to be polished is swung over the polishing pad 4 in a direction along the X axis by a swinging means 16.

The swinging means 16 moves the material to be polished 1 right over the thickness measuring means 7. This state is shown in FIG. 18B. The holding means 2 for the material to be polished goes on rotating right over the thickness measuring means 7. As the holding means 2 for the material to be polished rotates, an angular signal from the rotary encoder 3 is set as a position of 0 degree. At this time, the polishing pad 4 and the material to be polished 1 are positioned as schematically shown in FIG. 18D. Then, the white light source which emits momentary light projects momentary white rays in synchronization to the surface to be polished of the material to be polished 1. The thickness measuring means 7 picks up an image of the surface to be polished by utilizing the momentary rays. On the basis of an image of a surface to be observed, the location detecting processor section 8 and the thickness measuring arithmetic section 9 are capable of detecting a location suited for measuring the thickness of the material to be polished and simultaneously measuring the thickness. The location detecting method and the thickness measuring method are the same that have already been described. When no necessity to polish the surface once again is judged from the measured result, it terminates the polishing. When it is necessary to polish the surface once again, the polishing apparatus adequately modify conditions for obtaining a desired thickness value by polishing the surface once again on the basis of the measured thickness value, i.e., a polishing time, a pressure to bring the material to be polished into contact with the polishing pad, etc. After the modification of the polishing conditions, the material to be polished 1 is moved by the swinging means 16 right over the polishing pad 4 and its entire surface is polished.

In order to prevent the thickness of the polished material from changing by polishing during the measurement of the thickness, it is preferable to keep the material to be measured apart from the polishing pad 4 during the measurement of the thickness in the second embodiment according to the present invention.

In the polishing apparatus according to the present invention, measurement of the thickness not only by the spectral reflectance method as in the second embodiment but also by the polarization analysis method described above.

The polishing apparatus according to the present invention is not limited to the second embodiment in which the surface to be polished of the material to be polished 1 is held by the holding means 2 for the material to be polished so as to face downward, but may be configured, for example, so that the surface to be polished of the material to be polished 1 is held by the polishing head 5 so as to face upward and the polishing pad 4 is held over the material to be polished 1 so as to oppose to the surface to be polished of the material to be polished 1.

Though the holding means 2 for the material to be polished and the polishing head 5 are rotated independently during the polishing in the second embodiment described above, it is possible to configure the polishing apparatus as described in the second embodiment according to the present invention so as to rotate at least one of the holding means 2 for the material to be polished and the polishing head 5, or to rotate only the polishing head 5 without rotating the holding means 2 for the material to be polished.

The polishing apparatus as described in the second embodiment according to the present invention may be configured not only to rotate the holding means 2 for the material to be polished and the polishing head 5 independently as in the second embodiment but also to rotate at least one of the holding means 2 for material to be polished and the polishing head 5, and additionally revolve at least one of them by a driving means (not shown in the drawings).

Further, the polishing apparatus according to the present invention may be configured to rotate the holding means 2 for the material to be polished and the polishing head 5 not only in the same direction as in the second embodiment but also to rotate these members in direction opposite to each other.

Though the polishing pad 4 is made of polyurethane in the second embodiment described above, the polyurethane may be foamed polyurethane, porous polyurethane or polyurethane having a high density and a high stiffness. Furthermore, the polishing pad 4 used in the polishing apparatus according to the present invention may be made of a material other than polyurethane, for example, teflon, etc.

The slurry used in the polishing apparatus according to the present invention is a slurry prepared by dispersing fine particles of, for example, silica ($SiO_2$ or the like), aluminum oxide ($Al_2O_3$ or the like), manganese oxide ($MnO_2$ or the like) or cerium oxide (CeO) in a liquid containing sodium hydroxide (NaOH), potassium hydroxide (KOH) hydrogen peroxide ($H_2O_2$) or the like. It is more preferable to use a slurry containing fine particles of $SiO_2$ or GeO dispersed therein with respect to a material to be polished 1 comprising Si, or a slurry containing fine particles of aluminum oxide or manganese oxide dispersed therein with respect to a material to be polished 1 comprising a metal such as Al, Cu, W or the like. Furthermore, it is preferable that the fine particles have a particle size of approximately 8 nm to 50 nm and a relatively uniform particle size distribution.

Materials to be polished by the polishing apparatus according to the present invention include, for example, nearly circular SOI substrates, semiconductor wafers made of Si, GaAs, InP or the like and wafers having insulating films or metal films formed on surfaces thereof which are produced in processes of forming semiconductor integrated circuits. The wafers mentioned above have a diameter not shorter than approximately 6 inches or 12 inches. Furthermore, the material to be polished 1 by the polishing apparatus according to the present invention is not necessarily be circular, and rectangular substrates for displays, etc. can also serve as an example of the material to be polished 1 by the polishing apparatus according to the present invention.

In the second embodiment of the present invention, it is possible to inject a liquid between the thickness measuring means 7 and the material to be polished 1 from a liquid injecting means not shown in the drawings prior to a measurement of the thickness and then carry out the measurement of the thickness in a condition where the liquid is maintained between these members. For this purpose, it is preferable to use a liquid which can remove the fine particles of the slurry and polishing rubbish from the material to be polished 1 so as to clean a polished surface to be subjected to the thickness measurement. It is preferable to use, for example, pure water, an aqueous solution of sodium hydroxide (NaOH) or potassium hydroxide (KOH), an organic liquid such as isopropyl alcohol or a mixed aqueous solution containing the organic liquid.

Third Embodiment

Figure 19A:
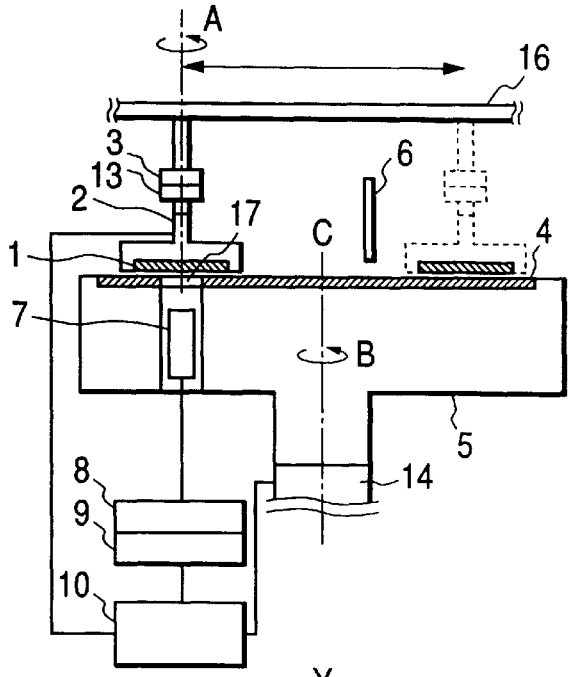
FIGS. 19A, 19B and 19C are schematic diagrams showing a third embodiment of the polishing apparatus according to the present invention.

A polishing apparatus according to a third embodiment of the present invention is characterized in that a thickness measuring means 7 is disposed in a polishing head 5 as shown in FIG. 19A. The third embodiment is the same as the first embodiment in other respects.

Figure 19B:
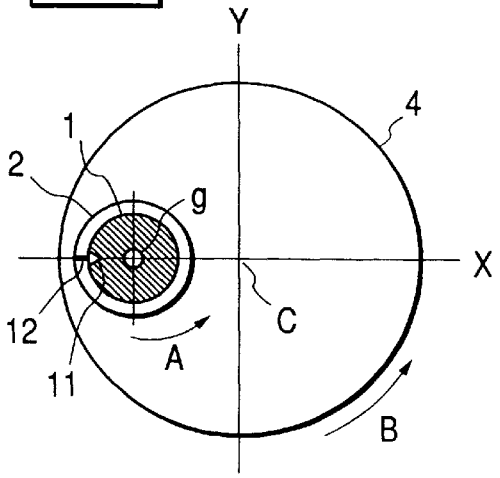

The thickness measuring means 7 is disposed under a region at which a polishing pad 4 is to be held. When a material to be polished is moved right over the thickness measuring means 7, it measures a surface to be polished of a material to be polished 1 by way of a light transmissive member 17 made of silicon oxide or the like and disposed within the region of the polishing pad 4. FIG. 19B is a schematic top view showing a positional relationship at this time between the polishing pad 4 and the material to be polished 1. The material to be polished is polished by the polishing pad 4 disposed at a location other than that of the thickness measuring means 7. When a thickness of the surface of the material to be polished is measured, the material is moved right over the thickness measuring means 7 by a swinging means 16. The polishing method and the thickness measuring method have already been described.

Figure 19C:
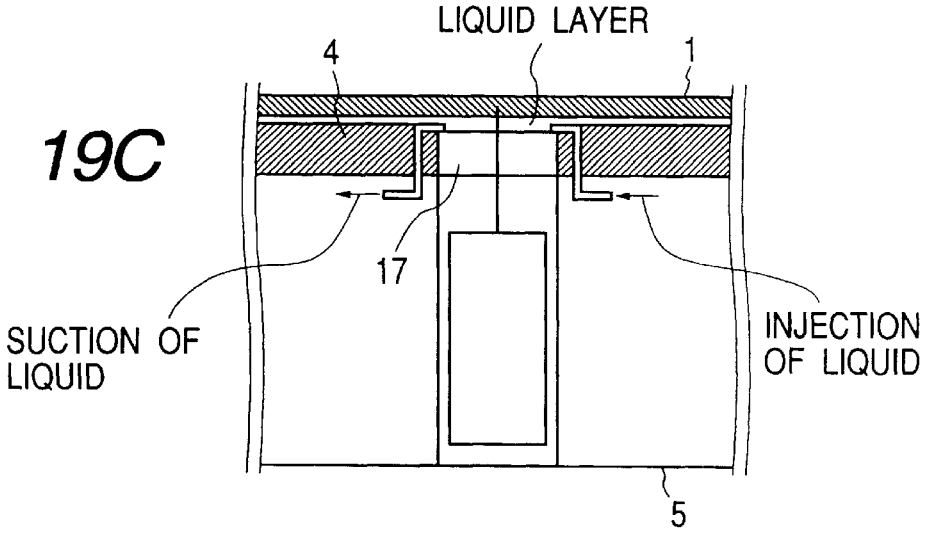

The polishing apparatus according to the third embodiment may be equipped, as shown in FIG. 19C, with means for supplying a liquid which removes fine particles of a slurry and polishing rubbishes from the polished surface of the material to be polished 1, and cleans a space between the material to be polished 1 and the light transmissive member 17. As a liquid to be used for this purpose, it is preferable to select one which is capable of removing the fine particles of the slurry and polishing rubbishes remaining on the material to be polished 1, for example, pure water, an aqueous solution of sodium hydroxide (NaOH), an aqueous solution of potassium hydroxide (KOH) an organic liquid such as isopropyl alcohol or a mixed aqueous solution containing the organic liquid.

In order to prevent the thickness of the material to be polished from being changed during a thickness measurement, it is preferable keep the material to be polished apart from the polishing pad 4 during the measurement in the third embodiment. It is preferable to densely supply a liquid to a gap between the material to be polished 1 and the transmissive member 17 in such case.

Fourth Embodiment

Figure 20A:
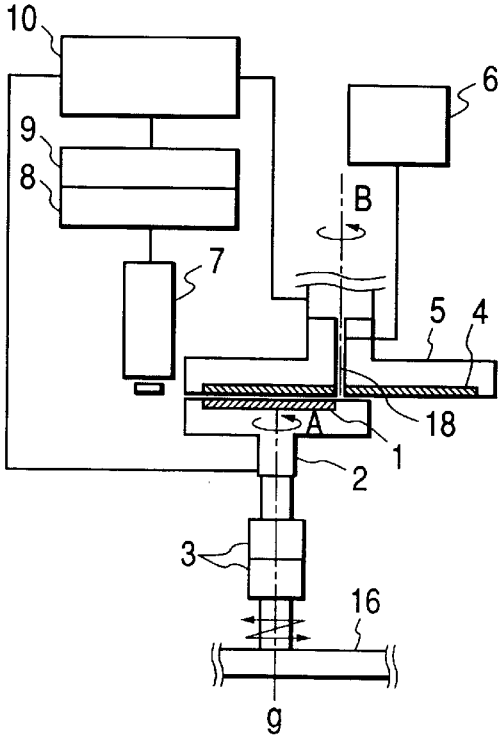
FIGS. 20A, 20B, 20C, 20D and 20E are schematic diagrams showing a fourth embodiment of the polishing apparatus according to the present invention.
Figure 20B:
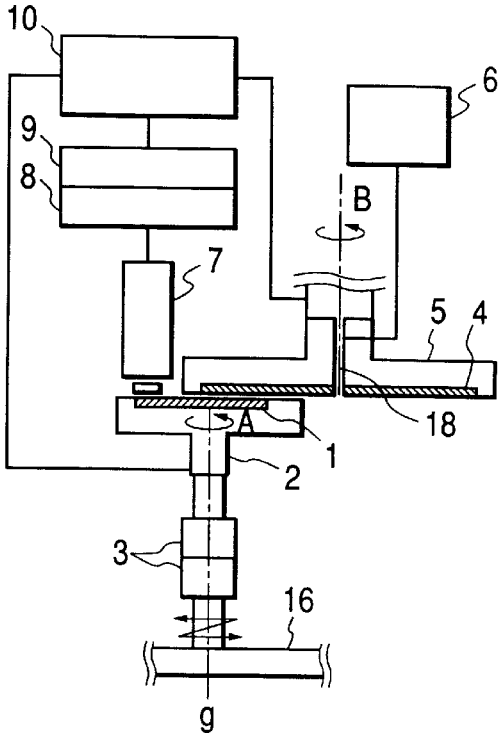

A polishing apparatus according to a fourth embodiment of the present invention is characterized in that a polishing pad 4 has a diameter 1 to 2 times larger than a diameter of a material to be polished 1 as shown in FIG. 20A. The fourth embodiment is the same as the first embodiment in other respects. In addition, a polishing head 5 has a diameter which is nearly equal to that of the polishing pad 4.

In the fourth embodiment, a holding means for the material to be polished holds the material to be polished 1 so that a surface to be polished faces upward, and the polishing head 5 holds the polishing pad 4 so as to be opposed to the surface to be polished.

Figure 20C:
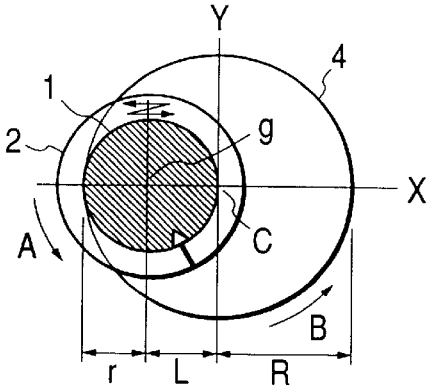

The holding means 2 for the material to be polished swings in a horizontal direction by means of the swinging means 16 at the time of polishing. FIG. 20C is a top view schematically showing the polishing pad 4 and the material to be polished 1. A total of a maximum value of a distance L as measured from a center of the surface to be polished which is swung to a center of the polishing pad 4 and a radius r of the material to be polished 1 is set so as not to exceed a radius R of the polishing pad 4.

Further, a thickness measuring means 7 is disposed above the material to be polished 1.

The polishing head 5 has a narrow slot 18 which communicates with a slurry supply means 6. The slurry supply means 6 supplies a slurry, through the narrow slot 18 and by way of the polishing pad, into a gap between the material to be polished 1 and the polishing pad 4 which are kept in contact with each other.

The polishing head 5 brings the polishing pad 4 into contact with the material to be polished 1 by a vertical driving means 15. The material to be polished 1 is polished by the holding means 2 for the material to be polished 1 and the polishing head 5 which rotate at high speed respectively.

Figure 20D:
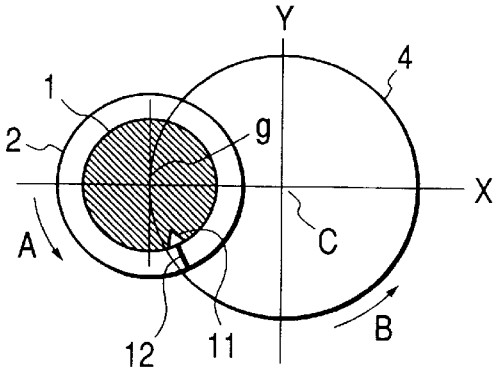

In the course of the polishing, the holding means 2 for the material to be polished is moved in a horizontal direction by the swinging means 16. FIG. 20D is a top view schematically showing a state where the material to be polished 1 partially protrudes from the polishing pad 4. In this state, the holding means 2 for the material to be polished moves horizontally so that a portion of the material to be polished 1 protrudes from the polishing head 4 and locates itself right under the thickness measuring means 7.

A location detecting step and a thickness measuring step are the same as those described in the first embodiment.

After completing the location detecting step and the thickness measuring step, the material to be polished 1 is polished again over an entire surface thereof.

In order to prevent the thickness of the material to be polished from being changed during a thickness measurement, it is preferable keep the material to be polished apart from the polishing pad 4 during the measurement in the fourth embodiment. It is preferable to densely supply a liquid to a gap between the material to be polished 1 and the transmissive optical member 17 in such case.

Figure 20E:
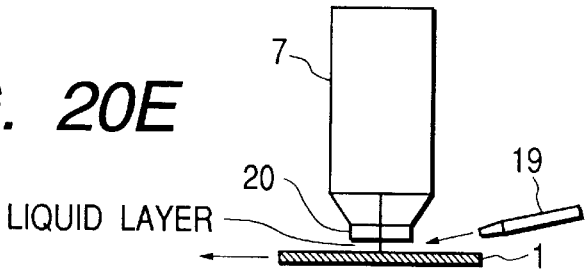

In the fourth embodiment of the present invention, before a thickness measurement, a liquid injecting means 19 shown in FIG. 20E may be used to inject a liquid to a gap between a liquid layer stabilizing glass plate 20 of the thickness measuring means 7 and the material to be polished 1 to measure the thickness of the material to be polished in a condition where the liquid is maintained between the glass plate 20 and the material to be polished 1. For the thickness measurement on a clean polished surface, it is preferable to select, as a liquid to be used for this purpose, one which is capable of removing fine particles of the slurry and polishing rubbish from the polished surface, or example, pure water, an aqueous solution of sodium hydroxide (NaOH), an aqueous solution of potassium hydroxide (KOH), an organic liquid such as isopropyl alcohol or mixed aqueous solution containing the organic liquid.

Since the fourth embodiment of the present invention uses the polishing head 5 having a diameter 1 to 2 times larger than that of the material to be polished 1, the polishing head 5 can be rotated for polishing the entire surface the material to be polished 1 with a power weaker than that required for rotating a polishing head having a diameter which is, for example, larger than twice that of the material to be polished 1 and at a speed higher than that of the latter polishing head. Further, the fourth embodiment which uses the small polishing head 5 makes it possible to make the polishing apparatus compact as a whole.

Fifth Embodiment

Figures 21A, 21B, 21C, 21D, 21E:
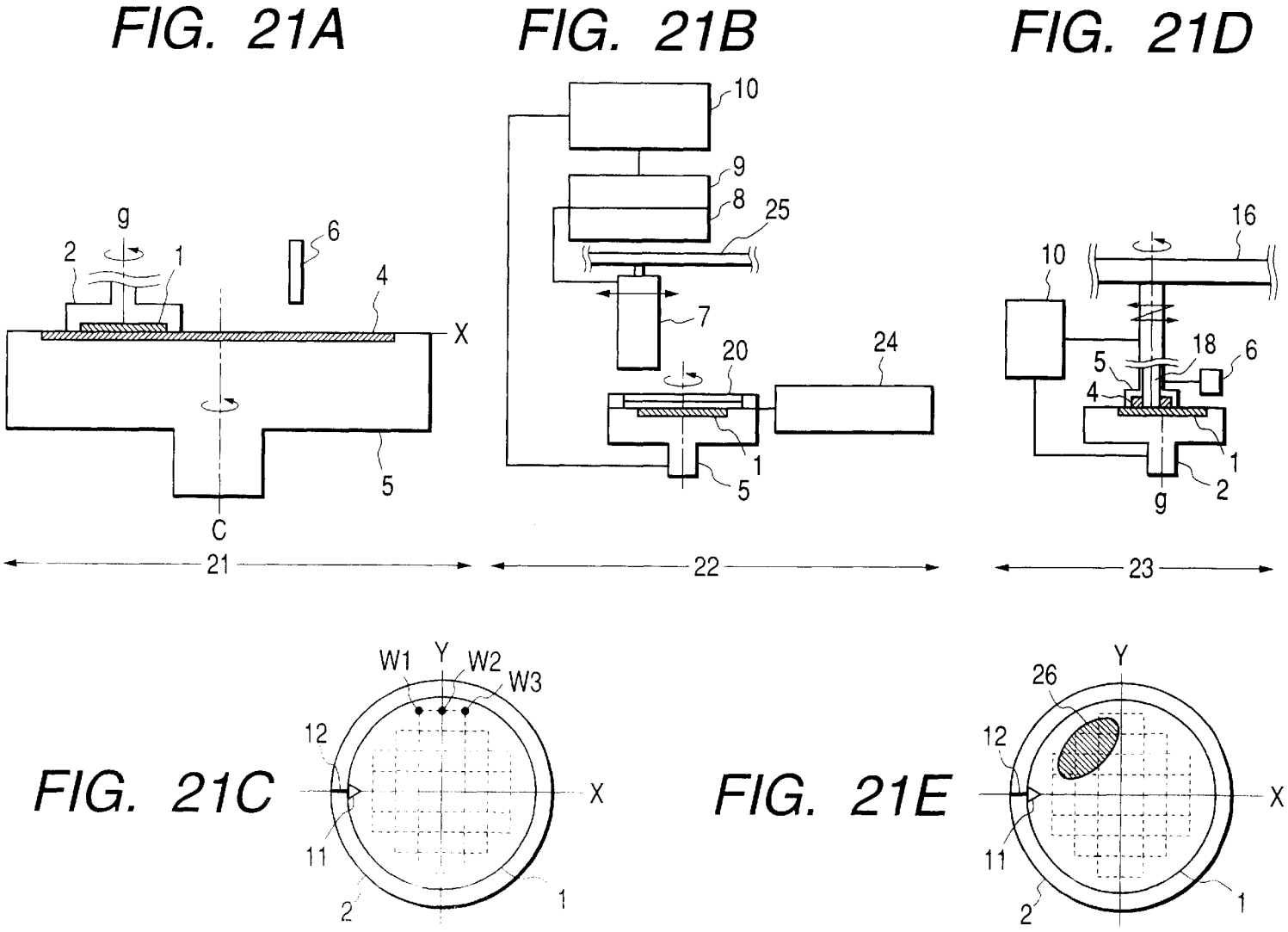
FIGS. 21A, 21B, 21C, 21D and 21E are schematic diagrams showing a fifth embodiment of the polishing apparatus according to the present invention.

A polishing apparatus according to a fifth embodiment of the present invention is characterized, as shown in FIGS. 21A, 21B and 21C, in that it comprises a coarse polishing unit 21 which coarsely polishes a material to be polished 1 with a polishing pad 4 having a diameter larger than that of a material to be polished 1, a thickness measuring unit 22 which has a thickness measuring means 7 for measuring the thickness of a surface to be polished of the material to be polished 1, and a finish polishing unit 23 which polishes only a portion to be polished of the surface to be polished with a polishing head 5 having a diameter smaller than that of the material to be polished 1 on the basis of the thickness value measured by the thickness measuring unit 22.

As shown in FIG. 21A, the coarse polishing unit 21 is same as the polishing apparatus as described in the first embodiment, except for the thickness measuring means 7, the location detecting processor section 8, the thickness measuring arithmetic section 9 and the polishing control means 10 which are not disposed in the coarse polishing unit 21.

The material to be polished 1 which has been coarsely polished by the coarse polishing unit 21 is conveyed to the thickness measuring unit 22 by a conveying means (not shown in the drawings).

FIG. 21B is a schematic side view of the thickness measuring unit 22.

The thickness measuring unit 22 comprises a thickness measuring means 7, a location detecting processor section 8, a thickness measuring arithmetic section 9, a shift control means 10, a holding means 2 for the material to be polished and a liquid supply circulating means 24. A liquid layer stabilizing glass plate 20 is disposed on the material to be polished 1 held by the holding means 2 for the material to be polished with a gap interposed therebetween. The liquid supply circulating means 24 supplies a liquid so as to circulate the liquid through the gap and recovers it. The circulating liquid can prevent polishing rubbishes produced during polishing and fine particles in a slurry from being adsorbed to the surface to be polished or remove the polishing rubbishes and the fine particles.

FIG. 21C is a schematic top view of the material to be polished 1 which is held by the holding means 2 for the material to be polished in the thickness measuring unit 22.

The thickness measuring means 7 is moved to a location W1 of the material to be polished 1 by a shift control means 25. While moving from the location W1 sequentially to locations W2 and W3 along an X axis and a Y axis which intersect perpendicularly with each other at a center of the material to be polished 1, the thickness measuring means 7 measures the thickness value and the thickness distribution by carrying out the detecting step and the thickness measuring step as described above at each location.

The material to be polished 1 which has been subjected to the thickness measurement is carried by a conveying means for the material to be polished (not shown in the drawings) to the holing means 2 for the material to be polished of the finish polishing unit 23 and held therein.

FIG. 21D is a schematic side view showing a configuration of the finish polishing unit 23. As shown in FIG. 21D, the finish polishing unit 23 is composed of the holding means 2 for the material to be polished which holds the material to be polished 1 so that its surface to be polished faces upward, and a polishing head 5 which holds a polishing pad 4 having a diameter smaller than that of the material to be polished 1. On the basis of a measured result of the thickness of the material to be polished 1 obtained by the thickness measuring unit 22, the shift control means 25 moves the polishing head 5 right over a portion 26 which could not be polished sufficiently in the coarse polishing unit 21. During polishing, a slurry supply means 6 which communicates with a narrow slot 18 formed in the polishing head 5 supplies a slurry, by way of the polishing pad 4, to a gap between the material to be polished 1 and the polishing pad 4 which are in contact with each other.

The polishing apparatus according to the present invention may be configured to measure the thickness not only by the spectral reflectance method as described in the fifth embodiment but also, for example, by the polarization analysis method described above.

EXAMPLE

Figure 22:
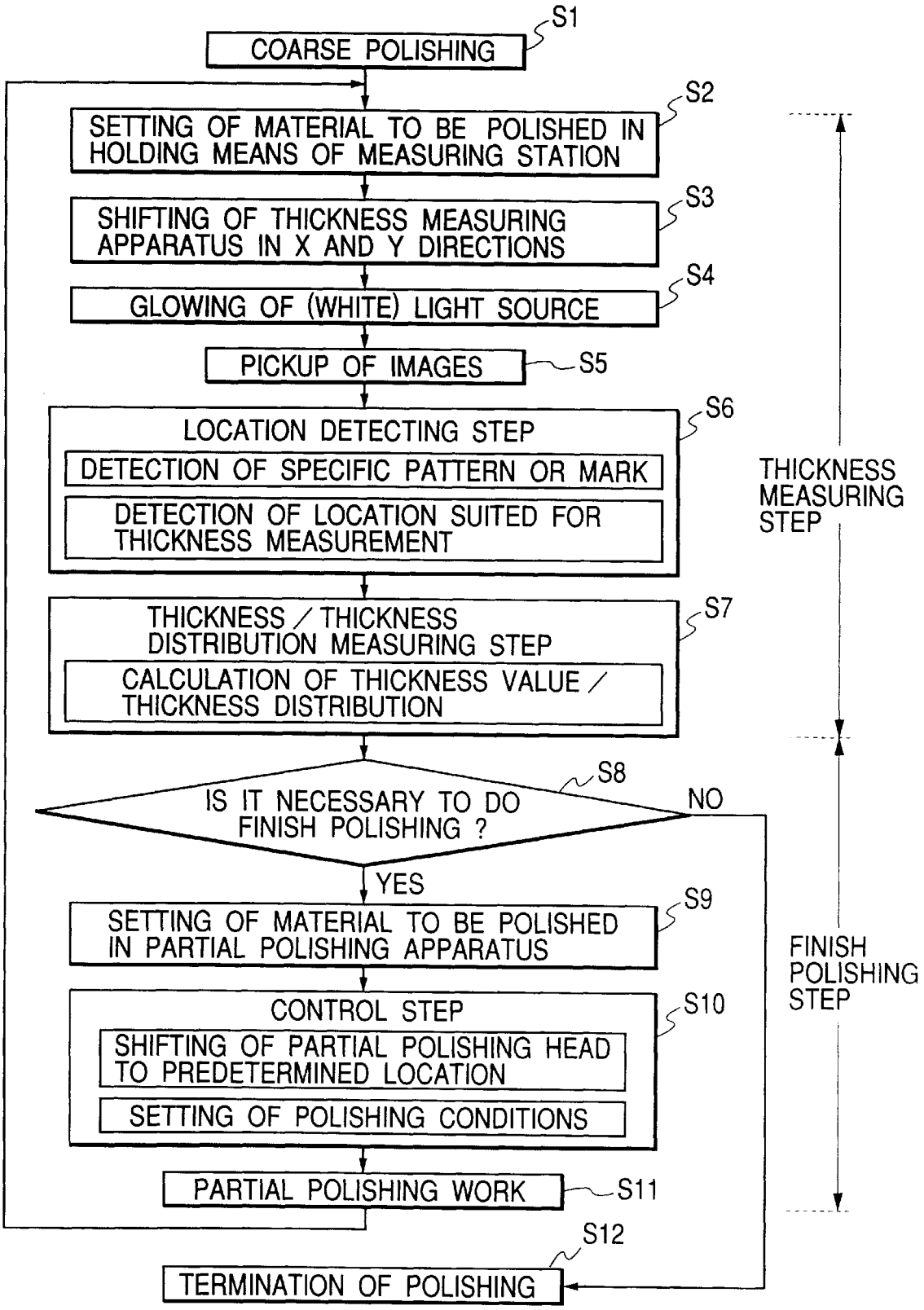
FIG. 22 is a flowchart illustrating steps for a coarse polishing step, a thickness measuring step and a finish polishing step in a due sequence.
Figure 23:
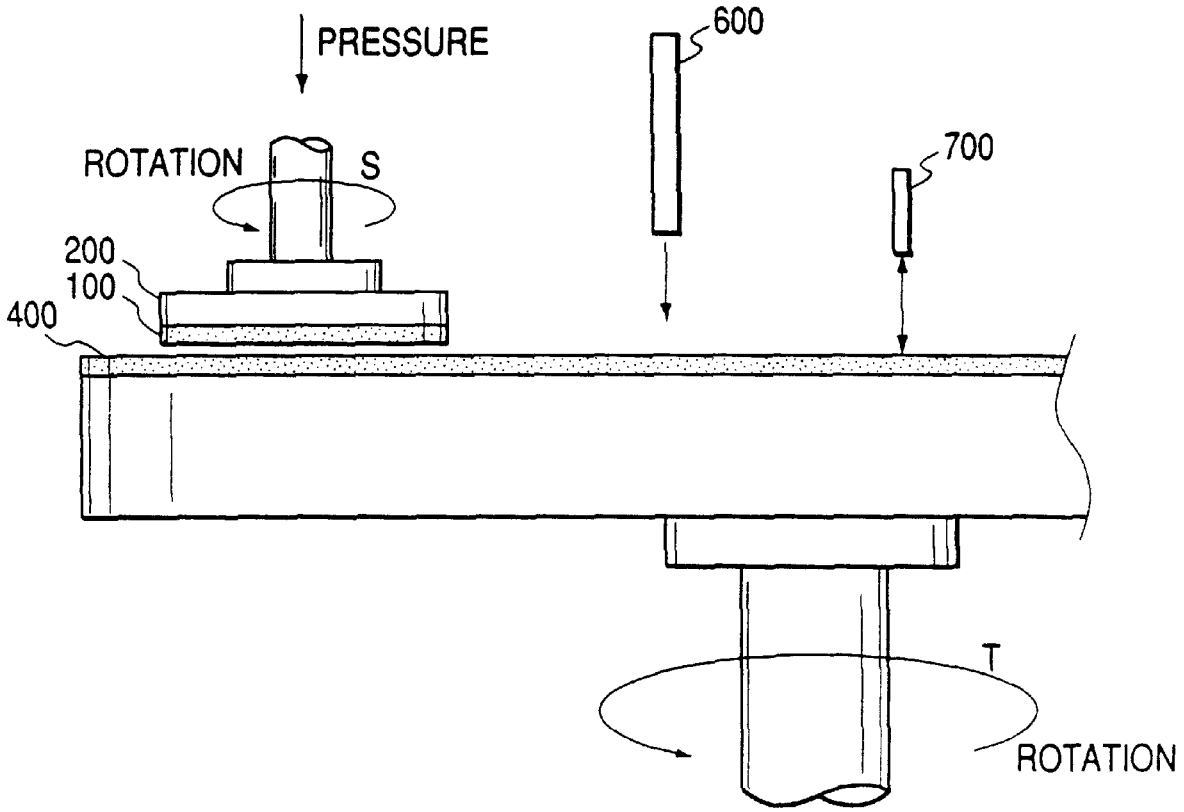
FIG. 23 is a sectional view schematically showing a polishing apparatus which the inventors used before achieving the present invention.

In the example of the present invention, a material to be polished is polished by a polishing process which is divided sequentially into a coarse polishing step (S1), thickness measuring steps (S2 to S8) and finish polishing steps (S9 to S11) by using the polishing apparatus of the fifth embodiment, as shown in a flowchart of FIG. 22.

The material to be polished 1 which has been coarsely polished in the coarse polishing unit 21 in the coarse polishing step (S1) is conveyed by a conveying means (not shown in the drawings) to the thickness measuring unit and held therein (S2) by a holding means 2 for the material to be polished. Then, the thickness measuring means 7 shifts right over the location W1 of a wafer shown in FIG. 21C (S3). When the film measuring means 7 locates itself right over the location W1, the momentary white light source glows (S4), whereby image information is obtained from reflected rays with the location W1 as a center of a light bundle (S5). On the basis of the obtained image information, a location which is suited for measuring the thickness of the material to be polished is detected by detecting a specific pattern or mark provided on the material to be polished 1 (S6). The thickness value or the thickness distribution is calculated at the location suited for measuring the thickness (S7). When the polishing apparatus judges that it is unnecessary to carry out finish polishing (S8), the polishing apparatus terminates the polishing (S12). When it is necessary to carry out the finish polishing, the material to be polished 1 is conveyed to the finish polishing unit 23 by a conveying means (not shown in the drawings) and held by the holding means 2 for the material to be polished (S9). The material to be polished 1 is fixed in a condition where the notch 11 is aligned with the standard mark 12 provided on the holding means 2 for the material to be polished. Then, the polishing head 5 which has a diameter smaller than that of the material to be polished 1 moves to a location where the finish polishing is to be performed on the basis of the information obtained in the location detecting step S6, sets conditions required for the finish polishing on the basis of the information obtained in the thickness or thickness distribution measurement step S7 (S10) and polishes the material to be polished 1 (S11). After completing the finish polishing step, the material to be polished 1 is subjected again to the thickness measuring step and the polishing apparatus judges whether or not the material to be polished 1 is to be subjected to the finish polishing once again. When the material to be polished 1 is judged that it does not require the finish polishing, the polishing apparatus terminates the polishing step (S12).

As described above, the polishing apparatus according to the present invention is capable of picking up images of the surface to be polished of the material to be polished by using the thickness measuring means of the polishing apparatus, determining a location suited for measuring the thickness of the material to be polished in a short time and with high precision on the basis of information of two-dimensional images, accurately measuring the thickness and polishing the material to be polished with high precision on the basis of an obtained thickness measurement result. Accordingly, the polishing apparatus according to the present invention makes it possible to shorten a time required for treating a material to be polished.

What is claimed is:

1. A thickness measuring apparatus for measuring a thickness of a surface of a material to be polished, for use in a polishing apparatus, which comprises:

a light source for irradiating the surface of the material to be polished with momentary light;

an image acquirer, arranged to acquire an image of the surface by the momentary light; and a thickness measurer, arranged to specify a location at which a thickness of the material to be polished is to be polished from the image and measuring the thickness at the location.

2. A thickness measuring apparatus according to claim 1, wherein the momentary light is white light.

3. A thickness measuring apparatus according to claim 1, wherein the momentary light is light having a plurality of wavelengths.

4. A thickness measuring method of measuring a thickness of a surface of a material to be polished which is rotating, which method comprises:

an irradiation step of irradiating the surface of the material to be polished with momentary light;

an image acquisition step of acquiring an image of the surface by the momentary light; and an optical measurement step of specifying a location at which a thickness of the material to be polished is to be measured from the image and measuring the thickness at the location.

5. A thickness measuring apparatus according to claim 4, wherein the momentary light is white light.

6. A thickness measuring apparatus according to claim 4, wherein the momentary light is light having a plurality of wavelengths.

* * * * *

UNITED STATES PATENT AND TRADEMARK OFFICE

CERTIFICATE OF CORRECTION

PATENT NO. : 6,142,855
DATED : November 7, 2000
INVENTOR(S) : Masaru Nyui et al.

It is certified that error appears in the above-identified patent and that said Letters Patent is hereby corrected as shown below:

Column 2,
Line 28, "two dimensional" should read -- two-dimensional --.

Column 5,
Line 21, "invention) should read -- Invention) --;
Line 40, "word," should read -- words, --; and
Line 50, "detects" should read -- detect --.

Column 8,
Line 51, "value di" should read -- value $d_i$ --; and
Line 56, "*di*" should read -- $d_i$ --.

Column 9,
Line 43, "of" should read -- to --; and
Line 51, "N'=N 2" should read -- N'=N-2 --.

Column 10,
Line 25, "favorably" should read -- favorable --.

3

Column 11,
Line 59, "Two dimensional" should read -- Two-dimensional --; and
Line 60, "60*c*" should read -- 69*c* --.

Column 12,
Line 34, "wavelength $\lambda_i$" should read -- wavelengths $\lambda_i$ --;
Line 35, "two dimensional" should read -- two-dimensional --; and
Line 43, "two dimensional" should read -- two-dimensional --.

Column 13,
Line 17, "length $\lambda_i$" should read -- lengths $\lambda_i$ --;
Line 23, "elements $74_\alpha$," should read -- elements $74\alpha$, --;
Line 26, "a zimumths" should read -- azimuths --;
Line 32, "$H_2=(2\cdot I_{45)/(I0}+I_{90})-1$" should read -- $H_2=(2\cdot I_{45})/(I_0+I_{90})-1$ --;
Line 34, "tang" should read -- $\tan\Psi_i$ --; and
Line 39, "$\Delta_i=\tan^{-1}\{1-H_1^2-H_2^2)^{1/2H}{}_2\}$" should read -- $\Delta_i=\tan^{-1}\{1-H_1^2-H_2^2)^{1/2}H_2\}$ --.

Column 14,
Line 43, "$T_2(K)=(\tan\Psi-\tan\Psi_{2K})^2+(\Delta_2-\Delta_{2K})^2$" should read -- $T_2(K)=(\tan\Psi_2-\tan\Psi_{2K})^2+(\Delta_2-\Delta_{2K})^2$ --; and
Line 55, "$d_3$" should read -- $d_{3c}$ --.

UNITED STATES PATENT AND TRADEMARK OFFICE

CERTIFICATE OF CORRECTION

PATENT NO. : 6,142,855
DATED : November 7, 2000
INVENTOR(S) : Masaru Nyui et al.

It is certified that error appears in the above-identified patent and that said Letters Patent is hereby corrected as shown below:

Column 15,
Line 15, "tang" should read -- $\tan\Psi_i$ --.

Column 19,
Line 46, "modify" should read -- modifies --.

Column 20,
Line 22, "material" should read -- the material --; and
Line 63, "is" should read -- need --.

Column 21,
Line 50, "(KOH)" should read -- (KOH), --.

Column 22,
Line 37, "head 4" should read -- polishing head 5 --.

Column 24,
Line 2, "holing" should read -- holding --.

Column 26,
Line 23, "apparatus" should read -- method --; and
Line 25, "apparatus" should read -- method --.

Signed and Sealed this

Eighteenth Day of December, 2001

*Attest:*

*Attesting Officer*

JAMES E. ROGAN
*Director of the United States Patent and Trademark Office*